US011851734B2

(12) United States Patent
Foltz, IV

(10) Patent No.: US 11,851,734 B2
(45) **Date of Patent: *Dec. 26, 2023**

(54) TITANIUM ALLOY

(71) Applicant: ATI Properties LLC, Albany, OR (US)

(72) Inventor: John W. Foltz, IV, Albany, OR (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/657,481

(22) Filed: Mar. 31, 2022

(65) Prior Publication Data

US 2022/0316030 A1 Oct. 6, 2022

Related U.S. Application Data

(63) Continuation of application No. 16/779,689, filed on Feb. 3, 2020, now Pat. No. 11,319,616, which is a continuation of application No. 16/122,450, filed on Sep. 5, 2018, now Pat. No. 10,619,226, which is a continuation of application No. 14/594,300, filed on Jan. 12, 2015, now Pat. No. 10,094,003.

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS

| | | | |
|---|---|---|---|
| 2,857,269 | A | 10/1958 | Vordahl |
| 2,893,864 | A | 7/1959 | Harris et al. |
| 2,932,886 | A | 4/1960 | Althouse |
| 2,974,076 | A | 3/1961 | Vordahl |
| 3,015,292 | A | 1/1962 | Bridwell |
| 3,025,905 | A | 3/1962 | Haerr |
| 3,060,564 | A | 10/1962 | Corral |
| 3,082,083 | A | 3/1963 | Levy et al. |
| 3,117,471 | A | 1/1964 | O'Connell et al. |
| 3,313,138 | A | 4/1967 | Spring et al. |
| 3,379,522 | A | 4/1968 | Vordahl |
| 3,436,277 | A | 4/1969 | Bomberger, Jr. et al. |
| 3,469,975 | A | 9/1969 | Bomberger, Jr. et al. |
| 3,489,617 | A | 1/1970 | Wuerfel |
| 3,584,487 | A | 6/1971 | Carlson |
| 3,605,477 | A | 9/1971 | Carlson |
| 3,615,378 | A | 10/1971 | Bomberger, Jr. et al. |
| 3,622,406 | A | 11/1971 | Vordahl |
| 3,635,068 | A | 1/1972 | Watmough et al. |
| 3,649,259 | A | 3/1972 | Heitman |
| 3,676,225 | A | 7/1972 | Owczarski et al. |
| 3,686,041 | A | 8/1972 | Lee |
| 3,802,877 | A | 4/1974 | Parris et al. |
| 3,815,395 | A | 6/1974 | Sass |
| 3,835,282 | A | 9/1974 | Sass et al. |
| 3,867,208 | A | 2/1975 | Grekov et al. |
| 3,922,899 | A | 12/1975 | Fremont et al. |
| 3,979,815 | A | 9/1976 | Nakanose et al. |
| 4,053,330 | A | 10/1977 | Henricks et al. |
| 4,067,734 | A | 1/1978 | Curtis et al. |
| 4,094,708 | A | 6/1978 | Hubbard et al. |
| 4,098,623 | A | 7/1978 | Ibaraki et al. |
| 4,120,187 | A | 10/1978 | Mullen |
| 4,121,953 | A | 10/1978 | Hull |
| 4,138,141 | A | 2/1979 | Andersen |
| 4,147,639 | A | 4/1979 | Lee et al. |
| 4,150,279 | A | 4/1979 | Metcalfe et al. |
| 4,163,380 | A | 8/1979 | Masoner |
| 4,197,643 | A | 4/1980 | Burstone et al. |
| 4,229,216 | A | 10/1980 | Paton et al. |
| 4,299,626 | A | 11/1981 | Paton et al. |
| 4,309,226 | A | 1/1982 | Chen |
| 4,472,207 | A | 9/1984 | Kinoshita et al. |
| 4,473,125 | A | 9/1984 | Addudle et al. |
| 4,482,398 | A | 11/1984 | Eylon et al. |
| 4,510,788 | A | 4/1985 | Ferguson et al. |
| 4,543,132 | A | 9/1985 | Berczik et al. |
| 4,614,550 | A | 9/1986 | Leonard et al. |
| 4,631,092 | A | 12/1986 | Ruckle et al. |

(Continued)

FOREIGN PATENT DOCUMENTS

| | | | |
|---|---|---|---|
| CA | 2787980 | A | 7/2011 |
| CN | 1070230 | A | 3/1993 |

(Continued)

OTHER PUBLICATIONS

Prozesky, Dawid J., Michael O. Bodunrin, and Lesley H. Chown. "Hot-deformation behaviour of α+ β Ti—Al—V—Fe experimental alloys." AIP Conference Proceedings. vol. 1896. No. 1. AIP Publishing LLC, 2017.*

Office Action dated Sep. 8, 2020 in U.S. Appl. No. 14/077,699.

Notice of Allowance dated Jun. 24, 2020 in U.S. Appl. No. 16/122,174.

Notice of Abandonment dated Nov. 27, 2020 in U.S. Appl. No. 15/897,219.

Notice of Abandonment dated Aug. 20, 2020 in U.S. Appl. No. 13/108,045.

Office Action dated Nov. 2, 2020 in U.S. Appl. No. 16/439,859.

Wu, Quanxing, "High Strength a-β Titanium Alloy Capable of Producing Coils," Rare Metals Letters, Nov. 28, 2002, No. 11, pp. 19-20.

(Continued)

*Primary Examiner* — Jessee R Roe
(74) *Attorney, Agent, or Firm* — Robert J. Toth; K&L Gates LLP

(57) ABSTRACT

According to one embodiment, an alpha-beta titanium alloy comprises, in weight percentages: an aluminum equivalency in the range of about 6.7 to 10.0; a molybdenum equivalency in the range of 0 to 5.0; at least 2.1 vanadium; 0.3 to 5.0 cobalt; titanium; and incidental impurities.

24 Claims, 2 Drawing Sheets

(56) References Cited

U.S. PATENT DOCUMENTS 4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,798,632 A 1/1989 Yonezawa et al.
4,799,975 A 1/1989 Ouchi et al.
4,808,249 A 2/1989 Eyelon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,911,884 A 3/1990 Chang
4,917,728 A 4/1990 Enright
4,919,728 A 4/1990 Kohl et al.
4,943,412 A 7/1990 Bania et al.
4,957,567 A 9/1990 Krueger et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,094,812 A 3/1992 Dulmaine et al.
5,141,566 A 8/1992 Kitayama et al.
5,156,807 A 10/1992 Nagata et al.
5,160,554 A 11/1992 Bania et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,256,369 A 10/1993 Ogawa et al.
5,264,055 A 11/1993 Champin et al.
5,277,718 A 1/1994 Paxson et al.
5,310,522 A 5/1994 Culling
5,330,591 A 7/1994 Vasseur
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,374,323 A 12/1994 Kuhlman et al.
5,399,212 A 3/1995 Chakrabarti et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,527,403 A 6/1996 Schirra et al.
5,545,262 A 8/1996 Hardee et al.
5,545,268 A 8/1996 Yashiki et al.
5,547,523 A 8/1996 Blankenship et al.
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,305 A 6/1998 Benz et al.
5,759,484 A 6/1998 Kashii et al.
5,795,413 A 8/1998 Gorman
5,871,595 A 2/1999 Ahmed et al.
5,896,643 A 4/1999 Tanaka
5,897,830 A 4/1999 Abkowitz et al.
5,904,204 A 5/1999 Teraoka et al.
5,954,724 A 9/1999 Davidson
5,980,655 A 11/1999 Kosaka
6,002,118 A 12/1999 Kawano et al.
6,032,508 A 3/2000 Ashworth et al.
6,044,685 A 4/2000 Delgado et al.
6,053,993 A 4/2000 Reichman et al.
6,059,904 A 5/2000 Benz et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 4/2001 Matsubara et al.
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,334,912 B1 1/2002 Ganin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 3/2003 Luttgeharm
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 5/2003 Okada et al.
6,569,270 B2 5/2003 Segal
6,576,068 B2 6/2003 Grubb et al.
6,607,693 B1 8/2003 Saito et al.
6,632,304 B2 10/2003 Oyama et al.
6,632,396 B1 10/2003 Tetjukhin et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Ishii et al.
6,800,243 B2 10/2004 Tetyukhin et al.
6,823,705 B2 11/2004 Fukada et al.
6,908,517 B2 6/2005 Segal et al.
6,918,971 B2 7/2005 Fujii et al.
6,932,877 B2 8/2005 Raymond et al.
6,939,415 B2 9/2005 Iseda et al.
6,954,525 B2 10/2005 Deo et al.
6,971,256 B2 12/2005 Okada et al.
7,008,491 B2 3/2006 Woodfield
7,010,950 B2 3/2006 Cai et al.
7,032,426 B2 4/2006 Durney et al.
7,037,389 B2 5/2006 Barbier et al.
7,038,426 B2 5/2006 Hill
7,081,173 B2 7/2006 Bahar et al.
7,096,596 B2 8/2006 Hernandez, Jr. et al.
7,132,021 B2 11/2006 Kuroda et al.
7,152,449 B2 12/2006 Durney et al.
7,264,682 B2 9/2007 Chandran et al.
7,269,986 B2 9/2007 Pfaffmann et al.
7,332,043 B2 2/2008 Tetyukhin et al.
7,410,610 B2 8/2008 Woodfield et al.
7,438,849 B2 10/2008 Kuramoto et al.
7,449,075 B2 11/2008 Woodfield et al.
7,536,892 B2 5/2009 Amino et al.
7,559,221 B2 7/2009 Horita et al.
7,601,232 B2 10/2009 Fonte
7,611,592 B2 11/2009 Davis et al.
7,708,841 B2 5/2010 Saller et al.
7,837,812 B2 11/2010 Marquardt et al.

(56) References Cited

U.S. PATENT DOCUMENTS

| | | | |
|---|---|---|---|
| 7,879,286 | B2 | 2/2011 | Miracle et al. |
| 7,947,136 | B2 | 5/2011 | Saller |
| 7,984,635 | B2 | 7/2011 | Callebaut et al. |
| 8,037,730 | B2 | 10/2011 | Polen et al. |
| 8,043,446 | B2 | 10/2011 | Jung et al. |
| 8,048,240 | B2 | 11/2011 | Hebda et al. |
| 8,128,764 | B2 | 3/2012 | Miracle et al. |
| 8,211,548 | B2 | 7/2012 | Chun et al. |
| 8,226,568 | B2 | 7/2012 | Watson et al. |
| 8,311,706 | B2 | 11/2012 | Lu et al. |
| 8,316,687 | B2 | 11/2012 | Slattery |
| 8,336,359 | B2 | 12/2012 | Werz |
| 8,408,039 | B2 | 4/2013 | Cao et al. |
| 8,430,075 | B2 | 4/2013 | Qiao et al. |
| 8,454,765 | B2 | 6/2013 | Saller et al. |
| 8,499,605 | B2 | 8/2013 | Bryan |
| 8,551,264 | B2 | 10/2013 | Kosaka et al. |
| 8,568,540 | B2 | 10/2013 | Marquardt et al. |
| 8,578,748 | B2 | 11/2013 | Huskamp et al. |
| 8,597,442 | B2 | 12/2013 | Hebda et al. |
| 8,597,443 | B2 | 12/2013 | Hebda et al. |
| 8,608,913 | B2 | 12/2013 | Shim et al. |
| 8,613,818 | B2 | 12/2013 | Forbes Jones et al. |
| 8,623,155 | B2 | 1/2014 | Marquardt et al. |
| 8,652,400 | B2 | 2/2014 | Forbes Jones et al. |
| 8,679,269 | B2 | 3/2014 | Goller et al. |
| 8,771,590 | B2 | 7/2014 | Valentinovich et al. |
| 8,834,653 | B2 | 9/2014 | Bryan |
| 8,919,168 | B2 | 12/2014 | Valiev et al. |
| 9,034,247 | B2 | 5/2015 | Suzuki et al. |
| 9,050,647 | B2 | 6/2015 | Thomas et al. |
| 9,192,981 | B2 | 11/2015 | Forbes Jones et al. |
| 9,206,497 | B2 | 12/2015 | Bryan et al. |
| 9,255,316 | B2 | 2/2016 | Bryan |
| 9,327,342 | B2 | 5/2016 | Oppenheimer et al. |
| 9,523,137 | B2 | 12/2016 | Marquardt et al. |
| 9,574,250 | B2 | 2/2017 | Nagao et al. |
| 9,616,480 | B2 | 4/2017 | Forbes Jones et al. |
| 9,624,567 | B2 | 4/2017 | Bryan et al. |
| 9,732,408 | B2 | 8/2017 | Sanz et al. |
| 9,765,420 | B2 | 9/2017 | Bryan |
| 9,777,361 | B2 | 10/2017 | Thomas et al. |
| 9,796,005 | B2 | 10/2017 | Hebda et al. |
| 9,869,003 | B2 | 1/2018 | Forbes Jones et al. |
| 10,053,758 | B2 | 8/2018 | Bryan |
| 10,094,003 | B2 | 10/2018 | Foltz |
| 10,144,999 | B2 | 12/2018 | Bryan |
| 10,287,655 | B2 | 5/2019 | Forbes Jones et al. |
| 10,337,093 | B2 | 7/2019 | Forbes Jones et al. |
| 10,370,741 | B2 | 8/2019 | Forbes Jones et al. |
| 10,370,751 | B2 | 8/2019 | Thomas et al. |
| 10,422,027 | B2 | 9/2019 | Marquardt et al. |
| 10,435,775 | B2 | 10/2019 | Forbes Jones et al. |
| 10,502,252 | B2 | 12/2019 | Foltz et al. |
| 10,513,755 | B2 | 12/2019 | Bryan |
| 10,570,469 | B2 | 2/2020 | Forbes Jones et al. |
| 10,619,226 | B2 | 4/2020 | Foltz et al. |
| 10,808,298 | B2 | 10/2020 | Foltz et al. |
| 11,111,552 | B2 | 9/2021 | Foltz et al. |
| 11,319,616 | B2 | 5/2022 | Foltz, IV |
| 2002/0033717 | A1 | 3/2002 | Matsuo |
| 2003/0168138 | A1 | 9/2003 | Marquardt |
| 2004/0099350 | A1 | 5/2004 | Manitone et al. |
| 2004/0148997 | A1 | 8/2004 | Amino et al. |
| 2004/0221929 | A1 | 11/2004 | Hebda et al. |
| 2004/0250932 | A1 | 12/2004 | Briggs |
| 2005/0028905 | A1 | 2/2005 | Riffee, Jr. |
| 2005/0047952 | A1 | 3/2005 | Coleman |
| 2005/0145310 | A1 | 7/2005 | Bewlay et al. |
| 2006/0045789 | A1 | 3/2006 | Nasserrafi et al. |
| 2006/0110614 | A1 | 5/2006 | Liimatainen |
| 2006/0243356 | A1 | 11/2006 | Oikawa et al. |
| 2007/0009858 | A1 | 1/2007 | Hatton et al. |
| 2007/0017273 | A1 | 1/2007 | Haug et al. |
| 2007/0098588 | A1 | 5/2007 | Narita et al. |
| 2007/0193662 | A1 | 8/2007 | Jablokov et al. |
| 2008/0000554 | A1 | 1/2008 | Yaguchi et al. |
| 2008/0103543 | A1 | 5/2008 | Li et al. |
| 2008/0107559 | A1 | 5/2008 | Nishiyama et al. |
| 2008/0202189 | A1 | 8/2008 | Otaki |
| 2008/0210345 | A1 | 9/2008 | Tetyukhin et al. |
| 2008/0264932 | A1 | 10/2008 | Hirota |
| 2009/0000706 | A1 | 1/2009 | Huron et al. |
| 2009/0183804 | A1 | 7/2009 | Zhao et al. |
| 2009/0234385 | A1 | 9/2009 | Cichocki et al. |
| 2011/0183151 | A1 | 7/2011 | Yokoyama et al. |
| 2012/0067100 | A1 | 3/2012 | Stefansson et al. |
| 2012/0076611 | A1 | 3/2012 | Bryan |
| 2012/0076686 | A1 | 3/2012 | Bryan |
| 2012/0279351 | A1 | 11/2012 | Gu et al. |
| 2013/0062003 | A1 | 3/2013 | Shulkin et al. |
| 2013/0156628 | A1 | 6/2013 | Forbes Jones et al. |
| 2014/0261922 | A1 | 9/2014 | Thomas et al. |
| 2015/0129093 | A1 | 5/2015 | Forbes Jones et al. |
| 2018/0195155 | A1 | 7/2018 | Bryan |
| 2020/0024696 | A1 | 1/2020 | Foltz, IV |
| 2020/0032833 | A1 | 1/2020 | Foltz, IV et al. |

FOREIGN PATENT DOCUMENTS

| | | | |
|---|---|---|---|
| CN | 1194671 | A | 9/1998 |
| CN | 1403622 | | 3/2003 |
| CN | 1816641 | A | 8/2006 |
| CN | 101104898 | A | 1/2008 |
| CN | 101205593 | A | 6/2008 |
| CN | 101294264 | A | 10/2008 |
| CN | 101372729 | A | 2/2009 |
| CN | 101503771 | A | 8/2009 |
| CN | 101684530 | A | 3/2010 |
| CN | 101637789 | B | 6/2011 |
| CN | 102212716 | A | 10/2011 |
| CN | 102816953 | A | 12/2012 |
| DE | 19743802 | A1 | 3/1999 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1433863 | | 6/2004 |
| EP | 1471158 | A1 | 10/2004 |
| EP | 1605073 | A1 | 12/2005 |
| EP | 1612289 | A2 | 1/2006 |
| EP | 1375690 | B1 | 3/2006 |
| EP | 1717330 | A1 | 11/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| FR | 2545104 | A1 | 11/1984 |
| GB | 847103 | | 9/1960 |
| GB | 1170997 | A | 11/1969 |
| GB | 1345048 | | 1/1974 |
| GB | 1433306 | | 4/1976 |
| GB | 1479855 | | 7/1977 |
| GB | 2151260 | A | 7/1985 |
| GB | 2198144 | A | 6/1988 |
| GB | 2337762 | A | 12/1999 |
| JP | 55-113865 | A | 9/1980 |
| JP | 57-62820 | A | 4/1982 |
| JP | 57-62846 | A | 4/1982 |
| JP | S57-202935 | A | 12/1982 |
| JP | S58-210156 | A | 12/1983 |
| JP | S58-210158 | A | 12/1983 |

(56) References Cited

FOREIGN PATENT DOCUMENTS

| | | | |
|---|---|---|---|
| JP | 60-046358 | | 3/1985 |
| JP | 60-100655 | A | 6/1985 |
| JP | S60-190519 | A | 9/1985 |
| JP | S61-060871 | | 3/1986 |
| JP | S61-217564 | A | 9/1986 |
| JP | S61-270356 | A | 11/1986 |
| JP | 62-109956 | A | 5/1987 |
| JP | 62-127074 | A | 6/1987 |
| JP | 62-149859 | A | 7/1987 |
| JP | S62-227597 | A | 10/1987 |
| JP | S62-247023 | A | 10/1987 |
| JP | S63-49302 | A | 3/1988 |
| JP | S63-188426 | A | 8/1988 |
| JP | H01-272750 | A | 10/1989 |
| JP | 1-279736 | A | 11/1989 |
| JP | 2-205661 | A | 8/1990 |
| JP | 3-134124 | A | 6/1991 |
| JP | H03-138343 | A | 6/1991 |
| JP | H03-155427 | A | 7/1991 |
| JP | H03-166350 | A | 7/1991 |
| JP | H03-264618 | A | 11/1991 |
| JP | H03-274238 | A | 12/1991 |
| JP | 4-74856 | A | 3/1992 |
| JP | 4-103737 | A | 4/1992 |
| JP | 4-143236 | A | 5/1992 |
| JP | 4-168227 | A | 6/1992 |
| JP | 5-59510 | A | 3/1993 |
| JP | 5-117791 | A | 5/1993 |
| JP | 5-195175 | A | 8/1993 |
| JP | H05-293555 | A | 11/1993 |
| JP | H06-93389 | A | 4/1994 |
| JP | 8-300044 | A | 11/1996 |
| JP | 9-143650 | | 6/1997 |
| JP | 9-194969 | A | 7/1997 |
| JP | 9-215786 | A | 8/1997 |
| JP | H10-128459 | A | 5/1998 |
| JP | H10-306335 | A | 11/1998 |
| JP | H11-21642 | A | 1/1999 |
| JP | H11-309521 | A | 11/1999 |
| JP | H11-319958 | A | 11/1999 |
| JP | 11-343528 | A | 12/1999 |
| JP | 11-343548 | A | 12/1999 |
| JP | 2000-153372 | A | 6/2000 |
| JP | 2000-234887 | A | 8/2000 |
| JP | 2001-71037 | A | 3/2001 |
| JP | 2001-081537 | A | 3/2001 |
| JP | 2001-343472 | A | 12/2001 |
| JP | 2002-69591 | A | 3/2002 |
| JP | 2002-146497 | A | 5/2002 |
| JP | 2003-55749 | A | 2/2003 |
| JP | 2003-73762 | A | 3/2003 |
| JP | 2003-74566 | A | 3/2003 |
| JP | 2003-285126 | A | 10/2003 |
| JP | 2003-334633 | A | 11/2003 |
| JP | 2004-131761 | | 4/2004 |
| JP | 2005-281855 | A | 10/2005 |
| JP | 2007-291488 | A | 11/2007 |
| JP | 2007-327118 | A | 12/2007 |
| JP | 2008-200730 | A | 9/2008 |
| JP | 2009-138218 | A | 6/2009 |
| JP | 2009-167502 | A | 7/2009 |
| JP | WO 2009/142228 | A1 | 11/2009 |
| JP | 2009-299110 | A | 12/2009 |
| JP | 2009-299120 | A | 12/2009 |
| JP | 2010-70833 | A | 4/2010 |
| JP | 2012-140690 | A | 7/2012 |
| JP | 2012-180542 | A | 9/2012 |
| JP | 2015-54332 | A | 3/2015 |
| KR | 920004946 | | 6/1992 |
| KR | 10-2005-0087765 | A | 8/2005 |
| KR | 10-2009-0069647 | A | 7/2009 |
| KR | 10-2011-0069602 | A | 6/2011 |
| RU | 2003417 | C1 | 11/1993 |
| RU | 1131234 | C | 10/1994 |
| RU | 2156828 | C1 | 9/2000 |
| RU | 2197555 | C1 | 7/2001 |
| RU | 2172359 | C1 | 8/2001 |
| RU | 2217260 | C1 | 11/2003 |
| RU | 2234998 | C1 | 8/2004 |
| RU | 2256713 | C1 | 7/2005 |
| RU | 2269584 | C1 | 2/2006 |
| RU | 2288967 | C1 | 12/2006 |
| RU | 2364660 | C1 | 8/2009 |
| RU | 2368695 | C1 | 9/2009 |
| RU | 2378410 | C1 | 1/2010 |
| RU | 2392348 | C2 | 6/2010 |
| RU | 2393936 | C1 | 7/2010 |
| RU | 2413030 | C1 | 2/2011 |
| RU | 2441089 | C1 | 1/2012 |
| RU | 2447185 | C1 | 4/2012 |
| SU | 534518 | A1 | 1/1977 |
| SU | 631234 | A | 11/1978 |
| SU | 1077328 | A | 5/1982 |
| SU | 1135798 | A1 | 1/1985 |
| SU | 1088397 | A1 | 2/1991 |
| UA | 38805 | A | 5/2001 |
| UA | 40862 | A | 8/2001 |
| UA | a200613448 | | 6/2008 |
| WO | WO 98/17836 | A1 | 4/1998 |
| WO | WO 98/22629 | A | 5/1998 |
| WO | WO 02/36847 | A2 | 5/2002 |
| WO | WO 02/070763 | A1 | 9/2002 |
| WO | WO 02/086172 | A1 | 10/2002 |
| WO | WO 02/090607 | A1 | 11/2002 |
| WO | WO 2004/101838 | A1 | 11/2004 |
| WO | WO 2006/071192 | A1 | 7/2006 |
| WO | WO 2007/084178 | A2 | 7/2007 |
| WO | WO 2007/114439 | A1 | 10/2007 |
| WO | WO 2007/142379 | A1 | 12/2007 |
| WO | WO 2008/017257 | A1 | 2/2008 |
| WO | WO 2009/082498 | A1 | 7/2009 |
| WO | WO 2009/102233 | A1 | 8/2009 |
| WO | WO 2010/084883 | A1 | 7/2010 |
| WO | WO 2012/063504 | A1 | 5/2012 |
| WO | WO 2012/147742 | A1 | 11/2012 |
| WO | WO 2013/081770 | A1 | 6/2013 |
| WO | WO 2013/130139 | A2 | 9/2013 |

OTHER PUBLICATIONS

Hui-qin, Chen et al., "Characterization of Hot Deformation Microstructures of Alpha-Beta Titanium Alloy With Equiaxed Structure," Transactions of Nonferrous Metals Society of China, Mar. 15, 2012, vol. 22, No. 3, pp. 503-509.

Notice of Allowance dated May 19, 2021 in U.S. Appl. No. 14/077,699.

Notice of Allowability dated May 26, 2021 in U.S. Appl. No. 14/077,699.

Notice of Abandonment dated May 11, 2021 in U.S. Appl. No. 16/439,859.

Office Action dated Nov. 1, 2021 in U.S. Appl. No. 16/779,689.

Office Action dated Mar. 3, 2022 in U.S. Appl. No. 16/779,689.

Notice of Allowance dated Mar. 15, 2022 in U.S. Appl. No. 16/779,689.

Notice of Abandonment dated Jul. 29, 2021 in U.S. Appl. No. 17/097,665.

"Allvac TiOsteum and TiOstalloy Beat Titanium Alloys", printed from www.allvac.com/allvac/pages/Titanium/TiOsteum.htm on Nov. 7, 2005.

"Datasheet: Timetal 21S", Alloy Digest, Advanced Materials and Processes (Sep. 1998), pp. 38-39.

"Heat Treating of Nonferrous Alloys: Heat Treating of Titanium and Titanium Alloys," Metals Handbook, ASM Handbooks Online (2002).

"Stryker Orthopaedics TMZF® Alloy (UNS R58120)", printed from www.allvac.com/allvac/pages/Titanium/UNSR58120.htm on Nov. 7, 2005.

"Technical Data Sheet: Allvac® Ti-15Mo Beta Titanium Alloy" (dated Jun. 16, 2004).

ASM Materials Engineering Dictionary, "Blasting or Blast Cleaning," J.R. Davis Ed., ASM International, Materials Park, OH (1992) p. 42.

(56) References Cited

OTHER PUBLICATIONS

"ASTM Designation F1801-97 Standard Practice for Corrosion Fatigue Testing of Metallic Implant Materials" ASTM International (1997) pp. 876-880.
"ASTM Designation F2066-01 Standard Specification for Wrought Titanium-15 Molybdenum Alloy for Surgical Implant Applications (UNS R58150)," ASTM International (2000) pp. 1-4.
AL-6XN® Alloy (UNS N08367) Allegheny Ludlum Corporation, 2002, 56 pages.
Allegheny Ludlum, "High Performance Metals for Industry, High Strength, High Temperature, and Corrosion-Resistant Alloys", (2000) pp. 1-8.
Allvac, Product Specification for "Allvac Ti-15 Mo," available at http://www.allvac.com/allvac/pages/Titanium/Ti15MO.htm, last visited Jun. 9, 2003 p. 1 of 1.
Altemp® A286 Iron-Base Superalloy (UNS Designation S66286) Allegheny Ludlum Technical Data Sheet Blue Sheet, 1998, 8 pages.
ASM Materials Engineering Dictionary, J.R. Davis Ed., ASM International, Materials Park, OH (1992) p. 39.
ATI Datalloy 2 Alloy, Technical Data Sheet, ATI Allvac, Monroe, NC, SS-844, Version 1, Sep. 17, 2010, 8 pages.
ATI 38-644™ Beta Titanium Alloy Technical Data Sheet, UNS R58640, Version 1, Dec. 21, 2011, 4 pages.
ATI 690 (UNS N06690) Nickel-Base, ATI Allvac, Oct. 5, 2010, 1 page.
Isothermal forging definition, ASM Materials Engineering Dictionary, J.R. Davis ed., Fifth Printing, Jan. 2006, ASM International, p. 238.
Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
ASTM Designation F 2066-01, "Standard Specification for Wrought Titanium-15 Molybdenum Alloy for Surgical Implant Applications (UNS R58150)", May 2001, 7 pages.
ASTM Designation F 2066/F2066M-13, "Standard Specification for Wrought Titanium-15 Molybdenum Alloy for Surgical Implant Applications (UNS R58150)", Nov. 2013, 6 pages.
ATI 6-2-4-2™ Alloy Technical Data Sheet, Version 1, Feb. 26, 2012, 4 pages.
ATI 6-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 425® Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 425® Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 425® Alloy, Grade 38, Titanium Alloy, UNS R54250, Technical Data Sheet, Version 1, Nov. 25, 2013, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti-15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe-0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys—Cold Forming", ASM Handbook, 2006, ASM International, vol. 14B, 2 pages.
Beal et al., "Forming of Titanium and Titanium Alloys—Cold Forming", ASM Handbook, 2006, ASM International, Revised by ASM Committee on Forming Titanium Alloys, vol. 14B, 2 pages.
Beal et al., "Forming of Titanium and Titanium Alloys—Cold Forming", ASM Handbook, 2006, vol. 14B, pp. 656-669.
Bewlay, et al., "Superplastic roll forming of Ti alloys", Materials and Design, 21, 2000, pp. 287-295.
Bowen, A. W., "Omega Phase Embrittlement in Aged Ti-15%Mo," Scripta Metallurgica, vol. 5, No. 8 (1971) pp. 709-715.
Bowen, A. W., "On the Strengthening of A Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Craighead et al., "Ternary Alloys of Titanium", Journal of Metals, Mar. 1950, Transactions AIME, vol. 188, pp. 514-538.
Craighead et al., "Titanium Binary Alloys", Journal of Metals, Mar. 1950, Transactions AIME, vol. 188, pp. 485-513.
Desrayaud et al., "A novel high straining process for bulk materials—The development of a multipass forging system by compression along three axes", Journal of Materials Processing Technology, 172, 2006, pp. 152-158.
Diderrich et al., "Addition of Cobalt to the Ti—6Al—4V Alloy", Journal of Metals, May 1968, pp. 29-37.
DiDomizio, et al., "Evaluation of a Ni—20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-17.
Disegi, John, Wrought Titanium-15% Molybdenum Implant Material, Original Instruments and Implants of the Association for the Study of International Fixation—AO ASIF, Oct. 2003.
Donachie Jr., M.J., "Titanium A Technical Guide" 1988, ASM, pp. 39 and 46-50.
Donachie Jr., M.J., "Heat Treating Titanium and Its Alloys", Heat Treating Process, Jun./Jul. 2001, pp. 47-49, 52-53, and 56-57.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.

(56) References Cited

OTHER PUBLICATIONS

Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. by R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys-Solution Treating and Aging", ASM Handbook, 1991, ASM International, vol. 4, pp. 1-8.
Glazunov et al., Structural Titanium Alloys, Moscow, Metallurgy, 1974, pp. 264-283.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2004, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Hsieh, Chih-Chun and Weite Wu, "Overview of Intermetallic Sigma Phase Precipitation in Stainless Steels", ISRN Metallurgy, vol. 2012, 2012, pp. 1-16.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Imperial Metal Industries Limited, Product Specification for "IMI Titanium 205", The Kynoch Press (England) pp. 1-5. (1965).
Jablokov et al., "Influence of Oxygen Content on the Mechanical Properties of Titanium-35Niobium-7Zirconium-5Tantalum Beta Titanium Alloy," Journal of ASTM International, Sep. 2005, vol. 2, No. 8, 2002, pp. 1-12.
Jablokov et al., "The Application of Ti-15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", WEAR, 249(1-2), Jan. 17, 2001, 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications," Journal of ASTM International, vol. 2, Issue 9 (Oct. 2005) (published online Aug. 17, 2005).
Marquardt, Brian, "Characterization of Ti-15Mo for Orthopaedic Applications, "TMS 2005 Annual Meeting: Technical Program, San Francisco, CA, Feb. 13-17, 2005 Abstract, p. 239.
Marquardt, Brian, "Ti-15Mo Beta Titanium Alloy Processed for High Strength Orthopaedic Applications," Program and Abstracts for The Symposium on Titanium, Niobium, Zirconium, and Tantalum for Medical and Surgical Applications, Washington, D.C., Nov. 9-10, 2004 Abstract, p. 11.
Marte et al., "Structure and Properties of NI-20CR Produced by Severe Plastic Deformation", Ultrafine Grained Materials IV, 2006, pp. 419-424.
Materials Properties Handbook: Titanium Alloys, Eds. Boyer et al., ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn—Ti (Manganese-Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti-15Mo Alloy," Titanium '80 Science and Technology—Proceedings of the 4th International Conference on Titanium, H. Kimura & O. Izumi Eds. May 19-22, 1980 pp. 1335-1341.
Nguyen et al., "Analysis of bending deformation in triangle heating of steel plates with induction heating process using laminated plate theory", Mechanics Based Design of Structures and Machines, 37, 2009, pp. 228-246.
Nishimura, T. "Ti-15Mo—5Zr—3Al", Materials Properties Handbook: Titanium Alloys, eds. R. Boyer et al., ASM International, Materials Park, OH, 1994, p. 949.
Novikov et al., 17.2.2 Deformable ($\alpha + \beta$) alloys, Chapter 17, Titanium and its Alloys, Metal Science, vol. II Thermal Treatment of the Alloy, Physical Matallurgy, 2009, pp. 357-360.
Nutt, Michael J. et al., "The Application of Ti-15 Beta Titanium Alloy in High Strength Structural Orthopaedic Applications," Program and Abstracts for The Symposium on Titanium Niobium, Zirconium, and Tantalum for Medical and Surgical Applications, Washington, D.C., Nove. 9-10, 2004 Abstract, p. 12.
Nyakana, et al., "Quick Reference Guide for $\beta$ Titanium Alloys in the 00s", Journal of Materials Engineering and Performance, vol. 14, No. 6, Dec. 1, 2005, pp. 799-811.
Pennock, G.M. et al., "The Control of a Precipitation By Two Step Ageing in $\beta$ Ti-15Mo," Titanium '80 Science and Technology—Proceedings of the 4th International Conference on Titanium, H. Kimura & O. Izumi Eds. May 19-22, 1980 pp. 1344-1350.
Prasad, Y.V.R.K et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.

(56) References Cited

OTHER PUBLICATIONS

Roach, M.D., et al., "Comparison of the Corrosion Fatigue Characteristics of CPTi-Grade 4, Ti—6A1-4V ELI, Ti—6A1-7 Nb, and Ti-15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems, Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.
Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium-6Aluminum-4Vanadium Alloy for Surgical Implant Applications (UNS R56400), Designation: F 1472-99, ASTM 1999, pp. 1-4.
Swann, P.R. and J. G. Parr, "Phase Transformations in Titanium-Rich Alloys of Titanium and Cobalt", Transactions of The Metallurgical Society of AIME, Apr. 1958, pp. 276-279.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V-xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
TIMET 6-6-2 Titanium Alloy (Ti—6Al—6V—2Sn), Annealed, accessed Jun. 27, 2012.
Timet Timetal® 6-2-4-2 (Ti—6Al—2Sn—4Zr—2Mo—0.08Si) Titanium Alloy datasheet, accessed Jun. 26, 2012.
Timet Timetal® 6-2-4-6 Titanium Alloy (Ti—6Al—2Sn—4Zr—6Mo), Typical, accessed Jun. 26, 2012.
Tokaji, Keiro et al., "The Microstructure Dependence of Fatigue Behavior in Ti-15Mo—5Zr—3Al Alloy," Materials Science and Engineering A., vol. 213 (1996) pp. 86-92.
Two new α-β titanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Yakymyshyn et al., "The Relationship between the Constitution and Mechanical Properties of Titanium-Rich Alloys of Titanium and Cobalt", 1961, vol. 53, pp. 283-294.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™ /ATI 800H™ /ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.

(56) References Cited

OTHER PUBLICATIONS

Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
AFML-TR-76-80 Development of Titanium Alloy Casting Technology, Aug. 1976, 5 pages.
Valiev et al., "Nanostructured materials produced by sever plastic deformation", Moscow, LOGOS, 2000.
Li et al., "The optimal determination of forging process parameters for Ti—6.5Al—3.5Mo—1.5Zr—0.3Si alloy with thick lamellar microstructure in two phase field based on P-map", Journal of Materials Processing Technology, vol. 210, Issue 2, Jan. 19, 2010, pp. 370-377.
Buijk, A., "Open-Die Forging Simulation", Forge Magazine, Dec. 1, 2013, 5 pages.
Herring, D., "Grain Size and Its Influence on Materials Properties", IndustrialHeating.com, Aug. 2005, pp. 20 and 22.
INCONEL® alloy 600, Special Metals Corporation, www.specialmetals.com, Sep. 2008, 16 pages.
Yaylaci et al., "Cold Working & Hot Working & Annealing", http://yunus.hacettepe.edu.tr/~selis/teaching/WEBkmu479/Ppt/kmu479Presentations2010/Cold_Hot_Working_Annealing.pdf, 2010, 41 pages.
Superaustenitic, http://www.atimetals.com/products/Pages/superaustenitic.aspx, Nov. 9, 2015, 3 pages.
French, D., "Austenitic Stainless Steel", The National Board of Boiler and Pressure Vessel Inspectors Bulletin, 1992, 3 pages.
Acom Magazine, outokumpu, NACE International, Feb. 2013, 16 pages.
ATI A286™ Iron Based Superalloy (UNS S66286) Technical Data Sheet, Allegheny Technologies Incorporated, Version 1, Apr. 17, 2012, 9 pages.
ATI A286™ (UNS S66286) Technical Data Sheet, Allegheny Technologies Incorporated, Version 1, Mar. 14, 2012, 3 pages.
Corrosion-Resistant Titanium, Technical Data Sheet, Allegheny Technologies Incorporated, Version 1, Feb. 29, 2012, 5 pages.
ATI 3-2.5™ Titanium (Ti Grade 9) Technical Data Sheet, ATI Wah Chang, 2010, 4 pages.
Grade 9 Ti 3Al 2.5V Alloy (UNS R56320), Jul. 30, 2013, http://www.azom.com/article.aspx?ArticleID=9337, 3 pages.
ATI Ti—6Al—4V, Grade 5, Titanium Alloy (UNS R56400) Technical Data Sheet, Allegheny Technologies Incorporated, Version 1, Jan. 31, 2012, 4 pages.
Panin et al., "Low-cost Titanium Alloys for Titanium-Polymer Layered Composites", 29th Congress of the International Council of the Aeronautical Sciences, St. Petersburg, Russia, Sep. 7, 2014, 4 pages.
Grade Ti—4.5Al—3V—2Mo—2Fe Alloy, Jul. 9, 2013, http://www.azom.com/article.aspx?ArticleID=9448, 2 pages.
Garside et al., "Mission Critical Metallics® Recent Developments in High-Strength Titanium Fasteners for Aerospace Applications", ATI, 2013, 21 pages.
Foltz et al., "Recent Developments in High-Strength Titanium Fasteners for Aerospace Applications", ATI, Oct. 22, 2014, 17 pages.
Kosaka et al., "Superplastic Forming Properties of TIMETAL® 54M", Henderson Technical Laboratory, Titanium Metals Corporation, ITA, Oct. 2010, Orlando, Florida, 18 pages.
Markovsky, P. E., "Preparation and properties of ultrafine (submicron) structure titanium alloys", Materials Science and Engineering, 1995, A203, 4 pages.
ATI Datalloy HP™ Alloy, UNS N08830, Technical Data Sheet Version 1, Apr. 14, 2015, 6 pages.
ATI Datalloy 2® Alloy, Technical Data Sheet, Version 1, Feb. 20, 2014, 6 pages.
Handa, Sukhdeep Singh, "Precipitation of Carbides in a Ni-based Superalloy", Degree Project for Master of Science with Specialization in Manufacturing Department of Engineering Science, University West, Jun. 30, 2014, 42 pages.
Titanium Alloy Guide, RMI Titanium Company, Jan. 2000, 45 pages.
Wanhill et al., "Chapter 2, Metallurgy and Microstructure", Fatigue of Beta Processed and Beta Heat-treated Titanium Alloys, SpringerBriefs in Applied Sciences and Technology, 2012, pp. 5-10.
Heat Treating of Titanium and Titanium Alloys, http://www.totalmateria.com/Article97.htm, Apr. 2004, 5 pages.
Grade 6Al 2Sn 4Zr 6Mo Titanium Alloy (UNS R56260), AZoM, http://www.azom.com/article.aspx?ArticleID=9305, Jun. 20, 2013, 4 pages.
Gammon et al., "Metallography and Microstructures of Titanium and Its Alloys", ASM Handbook, vol. 9: Metallography and Microstructures, ASM International, 2004, pp. 899-917.
Rui-gang Deng, et al. "Effects of Forging Process and Following Heat Treatment on Microstructure and Mechanical Properties of TC11 Titanium Alloy," Materials For Mechanical Engineering, vol. 35. No. 11, Nov. 2011, 5 pages. (English abstract included).
Srinivasan et al., "Rolling of Plates and Sheets from As-Cast Ti—6Al—4V-0.1 B, Journal of Materials Engineering and Performance", vol. 18.4, Jun. 2009, pp. 390-398.
Office Action dated Oct. 19, 2011 in U.S. Appl. No. 12/691,952.
Office Action dated Feb. 2, 2012 in U.S. Appl. No. 12/691,952.
Office Action dated Dec. 23, 2014 in U.S. Appl. No. 12/691,952.
Office Action dated Apr. 23, 2015 in U.S. Appl. No. 12/691,952.
Office Action dated Jul. 28, 2015 in U.S. Appl. No. 12/691,952.
Office Action dated Feb. 17, 2016 in U.S. Appl. No. 12/691,952.
Office Action dated Jun. 28, 2016 in U.S. Appl. No. 12/691,952.
Applicant-Initiated Interview Summary dated Aug. 22, 2016 in U.S. Appl. No. 12/691,952.
Advisory Action Before the Filing of an Appeal Brief dated Aug. 30, 2016 in U.S. Appl. No. 12/691,952.
Office Action dated Apr. 28, 2017 in U.S. Appl. No. 12/691,952.
Office Action dated Jul. 10, 2017 in U.S. Appl. No. 12/691,952.
Advisory Action dated Aug. 7, 2017 in U.S. Appl. No. 12/691,952.
Office Action dated Feb. 20, 2004 in U.S. Appl. No. 10/165,348.
Office Action dated Oct. 26, 2004 in U.S. Appl. No. 10/165,348.
Office Action dated Feb. 16, 2005 in U.S. Appl. No. 10/165,348.
Office Action dated Jul. 25, 2005 in U.S. Appl. No. 10/165,348.
Office Action dated Jan. 3, 2006 in U.S. Appl. No. 10/165,348.
Office Action dated Dec. 16, 2004 in U.S. Appl. No. 10/434,598.
Office Action dated Aug. 17, 2005 in U.S. Appl. No. 10/434,598.
Office Action dated Dec. 19, 2005 in U.S. Appl. No. 10/434,598.
Office Action dated Sep. 6, 2006 in U.S. Appl. No. 10/434,598.
Office Action dated Aug. 6, 2008 in U.S. Appl. No. 11/448,160.
Office Action dated Jan. 13, 2009 in U.S. Appl. No. 11/448,160.
Notice of Allowance dated Apr. 13, 2010 in U.S. Appl. No. 11/448,160.
Notice of Allowance dated Sep. 20, 2010 in U.S. Appl. No. 11/448,160.
Office Action dated Sep. 26, 2007 in U.S. Appl. No. 11/057,614.
Office Action dated Jan. 10, 2008 in U.S. Appl. No. 11/057,614.
Office Action dated Aug. 29, 2008 in U.S. Appl. No. 11/057,614.
Office Action dated Aug. 11, 2009 in U.S. Appl. No. 11/057,614.
Office Action dated Jan. 14, 2010 in U.S. Appl. No. 11/057,614.
Interview summary dated Apr. 14, 2010 in U.S. Appl. No. 11/057,614.
Office Action dated Jun. 21, 2010 in U.S. Appl. No. 11/057,614.
Notice of Allowance dated Sep. 3, 2010 in U.S. Appl. No. 11/057,614.
Office Action dated Apr. 1, 2010 in U.S. Appl. No. 11/745,189.
Interview summary dated Jun. 3, 2010 in U.S. Appl. No. 11/745,189.
Interview summary dated Jun. 15, 2010 in U.S. Appl. No. 11/745,189.
Office Action dated Nov. 24, 2010 in U.S. Appl. No. 11/745,189.
Interview summary dated Jan. 6, 2011 in U.S. Appl. No. 11/745,189.

(56) References Cited

OTHER PUBLICATIONS

Notice of Allowance dated Jun. 27, 2011 in U.S. Appl. No. 11/745,189.
Office Action dated Jan. 11, 2011 in U.S. Appl. No. 12/911,947.
Office Action dated Aug. 4, 2011 in U.S. Appl. No. 12/911,947.
Office Action dated Nov. 16, 2011 in U.S. Appl. No. 12/911,947.
Advisory Action dated Jan. 25, 2012 in U.S. Appl. No. 12/911,947.
Notice of Panel Decision from Pre-Appeal Brief Review dated Mar. 28, 2012 in U.S. Appl. No. 12/911,947.
Office Action dated Apr. 5, 2012 in U.S. Appl. No. 12/911,947.
Office Action dated Sep. 19, 2012 in U.S. Appl. No. 12/911,947.
Advisory Action dated Nov. 29, 2012 in U.S. Appl. No. 12/911,947.
Office Action dated May 31, 2013 in U.S. Appl. No. 12/911,947.
Notice of Allowance dated Oct. 4, 2013 in U.S. Appl. No. 12/911,947.
Office Action dated Jan. 3, 2011 in U.S. Appl. No. 12/857,789.
Office Action dated Jul. 27, 2011 in U.S. Appl. No. 12/857,789.
Advisory Action dated Oct. 7, 2011 in U.S. Appl. No. 12/857,789.
Notice of Allowance dated Jul. 1, 2013 in U.S. Appl. No. 12/857,789.
Office Action dated Nov. 14, 2012 in U.S. Appl. No. 12/885,620.
Office Action dated Jun. 13, 2013 in U.S. Appl. No. 12/885,620.
Office Action dated Nov. 19, 2013 in U.S. Appl. No. 12/885,620.
Advisory Action Before the Filing of an Appeal Brief dated Jan. 30, 2014 in U.S. Appl. No. 12/885,620.
Office Action dated Jun. 18, 2014 in U.S. Appl. No. 12/885,620.
Office Action dated Nov. 28, 2014 in U.S. Appl. No. 12/885,620.
Advisory Action dated May 18, 2015 in U.S. Appl. No. 12/885,620.
Office Action dated Jun. 30, 2015 in U.S. Appl. No. 12/885,620.
Notice of Abandonment dated Jan. 29, 2016 in U.S. Appl. No. 12/885,620.
Office Action dated Nov. 14, 2012 in U.S. Appl. No. 12/888,699.
Office Action dated Oct. 3, 2012 in U.S. Appl. No. 12/838,674.
Office Action dated Jul. 18, 2013 in U.S. Appl. No. 12/838,674.
Office Action dated May 27, 2015 in U.S. Appl. No. 12/838,674.
Applicant Initiated Interview Summary dated Sep. 1, 2015 in U.S. Appl. No. 12/838,674.
Notice of Allowance dated Sep. 25, 2015 in U.S. Appl. No. 12/838,674.
Office Action dated Sep. 26, 2012 in U.S. Appl. No. 12/845,122.
Notice of Allowance dated Apr. 17, 2013 in U.S. Appl. No. 12/845,122.
Office Action dated Dec. 24, 2012 in U.S. Appl. No. 13/230,046.
Notice of Allowance dated Jul. 31, 2013 in U.S. Appl. No. 13/230,046.
Office Action dated Dec. 26, 2012 in U.S. Appl. No. 13/230,143.
Notice of Allowance dated Aug. 2, 2013 in U.S. Appl. No. 13/230,143.
Office Action dated Mar. 1, 2013 in U.S. Appl. No. 12/903,851.
Office Action dated Jan. 16, 2014 in U.S. Appl. No. 12/903,851.
Office Action dated Oct. 6, 2014 in U.S. Appl. No. 12/903,851.
Office Action dated Jul. 15, 2015 in U.S. Appl. No. 12/903,851.
Examiner's Answer to Appeal Brief dated Oct. 27, 2016 in U.S. Appl. No. 12/903,851.
Office Action dated Mar. 25, 2013 in U.S. Appl. No. 13/108,045.
Office Action dated Jan. 17, 2014 in U.S. Appl. No. 13/108,045.
Office Action dated Mar. 30, 2016 in U.S. Appl. No. 13/108,045.
Office Action dated Sep. 9, 2016 in U.S. Appl. No. 13/108,045.
Advisory Action dated Mar. 7, 2017 in U.S. Appl. No. 13/108,045.
Office Action dated Apr. 16, 2013 in U.S. Appl. No. 13/150,494.
Office Action dated Jun. 14, 2013 in U.S. Appl. No. 13/150,494.
Notice of Allowance dated Nov. 5, 2013 in U.S. Appl. No. 13/150,494.
Supplemental Notice of Allowability dated Jan. 17, 2014 in U.S. Appl. No. 13/150,494.
U.S. Appl. No. 13/331,135, filed Dec. 20, 2011.
Office Action dated Jan. 21, 2015 in U.S. Appl. No. 13/792,285.
Office Action dated Jun. 4, 2015 in U.S. Appl. No. 13/792,285.
Notice of Allowance dated Sep. 16, 2015 in U.S. Appl. No. 13/792,285.
Response to Rule 312 Communication dated Oct. 20, 2015 in U.S. Appl. No. 13/792,285.
Notice of Allowance dated Oct. 24, 2014 in U.S. Appl. No. 13/844,545.
Notice of Allowance dated Feb. 6, 2015 in U.S. Appl. No. 13/844,545.
Office Action dated Jan. 23, 2013 in U.S. Appl. No. 12/882,538.
Office Action dated Feb. 8, 2013 in U.S. Appl. No. 12/882,538.
Notice of Allowance dated Jun. 24, 2013 in U.S. Appl. No. 12/882,538.
Office Action dated Sep. 6, 2013 in U.S. Appl. No. 13/933,222.
Notice of Allowance dated Oct. 1, 2013 in U.S. Appl. No. 13/933,222.
Notice of Allowance dated May 6, 2014 in U.S. Appl. No. 13/933,222.
Office Action dated Jun. 3, 2015 in U.S. Appl. No. 13/714,465.
Office Action dated Jul. 8, 2015 in U.S. Appl. No. 13/714,465.
Notice of Allowance dated Sep. 2, 2015 in U.S. Appl. No. 13/714,465.
Response to Rule 312 Communication dated Sep. 29, 2015 in U.S. Appl. No. 13/714,465.
Response to Rule 312 Communication dated Oct. 8, 2015 in U.S. Appl. No. 13/714,465.
Office Action dated Jun. 26, 2015 in U.S. Appl. No. 13/777,066.
Office Action dated Oct. 5, 2015 in U.S. Appl. No. 13/777,066.
Advisory Action Before the Filing of an Appeal Brief dated Mar. 17, 2016 in U.S. Appl. No. 13/777,066.
Office Action dated Jul. 22, 2016 in U.S. Appl. No. 13/777,066.
Office Action dated Oct. 12, 2016 in U.S. Appl. No. 13/777,066.
Office Action dated May 18, 2017 in U.S. Appl. No. 13/777,066.
Advisory Action Before the Filing of an Appeal Brief dated Jul. 10, 2017 in U.S. Appl. No. 13/777,066.
Notice of Allowance dated Aug. 30, 2017 in U.S. Appl. No. 13/777,066.
Office Action dated Aug. 19, 2015 in U.S. Appl. No. 13/844,196.
Office Action dated Oct. 15, 2015 in U.S. Appl. No. 13/844,196.
Office Action dated Feb. 12, 2016 in U.S. Appl. No. 13/844,196.
Advisory Action Before the Filing of an Appeal Brief dated Jun. 15, 2016 in U.S. Appl. No. 13/844,196.
Office Action dated Aug. 22, 2016 in U.S. Appl. No. 13/844,196.
Office Action dated Dec. 29, 2016 in U.S. Appl. No. 13/844,196.
Notice of Allowance dated Jul. 13, 2017 in U.S. Appl. No. 13/844,196.
Corrected Notice of Allowability dated Jul. 20, 2017 in U.S. Appl. No. 13/844,196.
Corrected Notice of Allowability dated Aug. 18, 2017 in U.S. Appl. No. 13/844,196.
Office Action dated Oct. 2, 2015 in U.S. Appl. No. 14/073,029.
Office Action dated Aug. 12, 2016 in U.S. Appl. No. 14/073,029.
Office Action dated Jun. 14, 2017 in U.S. Appl. No. 14/073,029.
Notice of Allowance dated Jul. 7, 2017 in U.S. Appl. No. 14/073,029.
Notice of Allowability dated Sep. 21, 2017 in U.S. Appl. No. 14/073,029.
Office Action dated Oct. 28, 2015 in U.S. Appl. No. 14/093,707.
Office Action dated Mar. 17, 2016 in U.S. Appl. No. 14/093,707.
Advisory Action Before the Filing of an Appeal Brief dated Jun. 10, 2016 in U.S. Appl. No. 14/093,707.
Office Action dated Sep. 30, 2016 in U.S. Appl. No. 14/093,707.
Notice of Allowance dated Jan. 13, 2017 in U.S. Appl. No. 14/093,707.
Supplemental Notice of Allowance dated Jan. 27, 2017 in U.S. Appl. No. 14/093,707.
Supplemental Notice of Allowance dated Feb. 10, 2017 in U.S. Appl. No. 14/093,707.
Supplemental Notice of Allowability dated Mar. 1, 2017 in U.S. Appl. No. 14/093,707.
Notice of Third-Party Submission dated Dec. 16, 2015 in U.S. Appl. No. 14/077,699.
Office Action dated Jul. 25, 2016 in U.S. Appl. No. 14/077,699.
Office Action dated Aug. 16, 2016 in U.S. Appl. No. 14/077,699.
Office Action dated Oct. 25, 2016 in U.S. Appl. No. 14/077,699.
Advisory Action dated Nov. 30, 2016 in U.S. Appl. No. 14/077,699.
Office Action dated Mar. 16, 2016 in U.S. Appl. No. 15/005,281.
Office Action dated Aug. 26, 2016 in U.S. Appl. No. 15/005,281.
Notice of Panel Decision from Pre-Appeal Brief Review dated Feb. 24, 2017 in U.S. Appl. No. 15/005,281.
Office Action dated Mar. 2, 2017 in U.S. Appl. No. 15/005,281.
Notice of Allowance dated May 10, 2017 in U.S. Appl. No. 15/005,281.
Corrected Notice of Allowability dated Aug. 9, 2017 in U.S. Appl. No. 15/005,281.
Office Action dated Apr. 5, 2016 in U.S. Appl. No. 14/028,588.
Office Action dated Aug. 8, 2016 in U.S. Appl. No. 14/028,588.
Advisory Action dated Oct. 14, 2016 in U.S. Appl. No. 14/028,588.

(56) References Cited

OTHER PUBLICATIONS

Applicant Initiated Interview Summary dated Oct. 27, 2016 in U.S. Appl. No. 14/028,588.
Office Action dated Mar. 15, 2017 in U.S. Appl. No. 14/028,588.
Office Action dated Jul. 14, 2017 in U.S. Appl. No. 14/028,588.
Advisory Action dated Sep. 12, 2017 in U.S. Appl. No. 14/028,588.
Office Action dated Apr. 13, 2016 in U.S. Appl. No. 14/083,759.
Office Action dated May 6, 2016 in U.S. Appl. No. 14/083,759.
Notice of Allowance dated Oct. 13, 2016 in U.S. Appl. No. 14/083,759.
Notice of Allowance dated Dec. 16, 2016 in U.S. Appl. No. 14/922,750.
Notice of Allowance dated Feb. 28, 2017 in U.S. Appl. No. 14/922,750.
Office Action dated Apr. 10, 2017 in U.S. Appl. No. 14/594,300.
Office Action dated May 25, 2017 in U.S. Appl. No. 14/594,300.
Office Action dated Sep. 13, 2017 in U.S. Appl. No. 14/594,300.
U.S. Appl. No. 15/348,140, filed Nov. 10, 2016.
U.S. Appl. No. 15/653,985, filed Jul. 19, 2017.
U.S. Appl. No. 15/659,661, filed Jul. 26, 2017.
Gil et al., "Formation of alpha-Widmanstatten structure: effects of grain size and cooling rate on the Widmanstatten morphologies and on the mechanical properties in Ti6Al4V alloy", Journal of Alloys and Compounds, 329, 2001, pp. 142-152.
Enayati et al., "Effects of temperature and effective strain on the flow behavior of Ti—6Al—4V", Journal of the Franklin Institute, 348, 2011, pp. 2813-2822.
Longxian et al., "Wear-Resistant Coating and Performance Titanium and Its Alloy, and properties thereof", Northeastern University Press, Dec. 2006, pp. 26-28, 33.
"Acceleration and Improvement for Heat Treating Workers," Quick Start and Improvement for Heat Treatment, ed. Yang Man, China Machine Press, Apr. 2008, pp. 265-266.
Decision on Appeal dated Dec. 15, 2017 in U.S. Appl. No. 12/903,851.
Corrected Notice of Allowability dated Dec. 20, 2017 in U.S. Appl. No. 13/777,066.
Office Action dated Dec. 1, 2017 in U.S. Appl. No. 14/077,699.
Notice of Panel Decision from Pre-Appeal Brief Review dated Oct. 27, 2017 in U.S. Appl. No. 14/028,588.
Advisory Action dated Jan. 26, 2018 in U.S. Appl. No. 14/594,300.
Office Action dated Oct. 31, 2017 in U.S. Appl. No. 15/653,985.
Office Action dated Dec. 6, 2017 in U.S. Appl. No. 14/948,941.
Office Action dated Feb. 27, 2018 in U.S. Appl. No. 13/108,045.
Interview Summary dated Mar. 12, 2018 in U.S. Appl. No. 14/077,699.
Notice of Allowance dated Feb. 9, 2018 in U.S. Appl. No. 14/028,588.
Office Action dated Feb. 28, 2018 in U.S. Appl. No. 14/594,300.
Office Action dated Mar. 16, 2018 in U.S. Appl. No. 15/653,985.
Office Action dated Apr. 2, 2018 in U.S. Appl. No. 14/881,633.
Forging Machinery, Dies, Processes, Metals Handbook Desk Edition, ASM International, 198, pp. 839-863.
Smith, et al. "Types of Heat-Treating Furnaces," Heat Treating, ASM Handbook, ASM International, 1991, vol. 4, p. 465-474.
Concise Explanation for Third Party Preissuance submission under Rule 1.290 filed in U.S. Appl. No. 15/678,527, filed Jun. 5, 2018.
Guidelines for PWR Steam Generator Tubing Specifications and Repair, Electric Power Research Institute, Apr. 14, 1999, vol. 2, Revision 1, 74 pages. (accessed at https://www.epri.com/#/pages/product/TR-016743-V2R1/).
Materials Reliability Program: Guidelines for Thermally Treated Alloy 690 Pressure Vessel Nozzels, (MRP-241), Electric Power Research Institute, Jul. 25, 2008, 51 pages. (accessed at https://www.epri.com/#/pages/product/1015007/).
Microstructure Etching and Carbon Analysis Techniques, Electric Power Research Institute, May 1, 1990, 355 pages. (accessed at https://www.epri.com/#/pages/product/NP-6720-SD/).
Frodigh, John, "Some Factors Affecting the Appearance of the Microstructure in Alloy 690", Proceedings of the Eighth International Symposium on Environmental Degradation of Materials in Nuclear Power Systems—Water Reactors, American Nuclear Society, Inc., vol. 1, Aug. 10, 1997, 12 pages.
Kajimura et al., "Corrosion Resistance of TT Alloy 690 Manufactured by Various Melting Processes in High Temperature NaOH Solution", Proceedings of the Eighth International Symposium on Environmental Degradation of Materials in Nuclear Power Systems—Water Reactors, American Nuclear Society, Inc., vol. 1, Aug. 10, 1997, pp. 149-156.
Notice of Allowance dated Jun. 6, 2018 in U.S. Appl. No. 12/691,952.
Notice of Allowability dated Jul. 20, 2018 in U.S. Appl. No. 12/691,952.
Office Action dated Apr. 6, 2018 in U.S. Appl. No. 12/903,851.
Office Action dated Jul. 17, 2018 in U.S. Appl. No. 14/077,699.
Notice of Allowance dated Sep. 6, 2018 in U.S. Appl. No. 14/028,588.
Notice of Allowance dated Jun. 29, 2018 in U.S. Appl. No. 14/594,300.
Corrected Notice of Allowability dated Jul. 9, 2018 in U.S. Appl. No. 14/594,300.
Notice of Allowance dated Aug. 15, 2018 in U.S. Appl. No. 15/653,985.
Office Action dated Jul. 30, 2018 in U.S. Appl. No. 14/948,941.
Office Action dated Aug. 6, 2018 in U.S. Appl. No. 14/881,633.
Notice of Allowance dated Jun. 22, 2018 in U.S. Appl. No. 15/433,443.
Notice of Allowability dated Aug. 27, 2018 in U.S. Appl. No. 15/433,443.
Office Action dated Aug. 28, 2018 in U.S. Appl. No. 15/678,527.
U.S. Appl. No. 16/122,450, filed Sep. 5, 2018.
The Japan Society for Heat Treatment, Introduction of Heat Treatment, Japan, Minoru, Kanai, Jan. 10, 1974, p. 150.
Angeliu et al., "Behavior of Grain Boundary Chemistry and Precipitates upon Thermal Treatment of Controlled Purity Alloy 690", Metallurgical Transactions A, vol. 21A, Aug. 1990, pp. 2097-2107.
Park et al., "Effect of heat treatment on fatigue crack growth rate of Inconel 690 and Inconel 600", Journal of Nuclear Materials, 231, 1996, pp. 204-212.
Louthan, M.R., "Optical Metallography", ASM Handbook, vol. 10, Materials Characterizations, 1986, pp. 299-308.
Kolachev B.A. et al., Titanium Alloys of Different Countries, Moscow, VILS, 2000, pp. 15-16.
High Strength Non-Magnetic Stainless Steel for Oil Drilling DNM series, Electric Steel Making, Daido Steel Co., Ltd., Japan, Jul. 27, 2012, vol. 83(1), pp. 75-76.
Office Action dated Oct. 26, 2018 in U.S. Appl. No. 12/903,851.
Office Action dated Jun. 27, 2019 in U.S. Appl. No. 12/903,851.
Office Action dated Jul. 12, 2019 in U.S. Appl. No. 12/903,851.
Corrected Notice of Allowability dated Aug. 14, 2019 in U.S. Appl. No. 12/903,851.
Office Action dated Nov. 2, 2018 in U.S. Appl. No. 13/108,045.
Office Action dated Jun. 27, 2019 in U.S. Appl. No. 13/108,045.
Office Action dated Feb. 10, 2020 in U.S. Appl. No. 13/108,045.
Office Action dated Jan. 10, 2019 in U.S. Appl. No. 14/077,699.
Office Action dated May 8, 2019 in U.S. Appl. No. 14/077,699.
Notification of Reopening Prosecution dated Dec. 19, 2018 in U.S. Appl. No. 14/028,588.
Office Action dated Feb. 1, 2019 in U.S. Appl. No. 14/028,588.
Notice of Allowance dated Jun. 26, 2019 in U.S. Appl. No. 14/028,588.
Office Action dated Feb. 15, 2018 in U.S. Appl. No. 14/948,941.
Applicant Initiated Interview Summary dated Jan. 30, 2019 in U.S. Appl. No. 14/948,941.
Office Action dated Feb. 15, 2019 in U.S. Appl. No. 14/948,941.
Notice of Allowance dated May 29, 2019 in U.S. Appl. No. 14/948,941.
Notice of Allowance dated Apr. 1, 2019 in U.S. Appl. No. 14/881,633.
Corrected Notice of Allowability dated May 15, 2019 in U.S. Appl. No. 14/881,633.
Corrected Notice of Allowability dated Sep. 6, 2018 in U.S. Appl. No. 15/433,443.
Notice of Allowability dated Oct. 11, 2018 in U.S. Appl. No. 15/433,443.
Corrected Notice of Allowability dated Oct. 18, 2018 in U.S. Appl. No. 15/433,443.
Notice of Allowance dated Dec. 13, 2018 in U.S. Appl. No. 15/678,527.

(56) References Cited

OTHER PUBLICATIONS

Corrected Notice of Allowability dated Apr. 15, 2019 in U.S. Appl. No. 15/678,527.
Office Action dated Dec. 9, 2019 in U.S. Appl. No. 16/122,174.
Office Action dated Sep. 16, 2019 in U.S. Appl. No. 16/122,450.
Office Action dated Dec. 20, 2019 in U.S. Appl. No. 16/122,450.
Notice of Allowance dated Jan. 21, 2020 in U.S. Appl. No. 16/122,450.
Office Action dated Jan. 10, 2019 in U.S. Appl. No. 15/659,661.
Notice of Allowance dated May 22, 2019 in U.S. Appl. No. 15/659,661.
Corrected Notice of Allowability dated May 29, 2019 in U.S. Appl. No. 15/659,661.
Office Action dated Jan. 25, 2019 in U.S. Appl. No. 15/348,140.
Notice of Allowance dated May 9, 2019 in U.S. Appl. No. 15/348,140.
Corrected Notice of Allowability dated Aug. 7, 2019 in U.S. Appl. No. 15/348,140.
Office Action dated Mar. 8, 2019 in U.S. Appl. No. 15/816,128.
Office Action dated Aug. 1, 2019 in U.S. Appl. No. 15/816,128.
Office Action dated Aug. 6, 2019 in U.S. Appl. No. 15/816,128.
Notice of Allowance dated Sep. 19, 2019 in U.S. Appl. No. 15/816,128.
Notice of Allowability dated Jan. 21, 2020 in U.S. Appl. No. 15/816,128.
Office Action dated May 13, 2020 in U.S. Appl. No. 15/897,219.

* cited by examiner

TITANIUM ALLOY

CROSS-REFERENCE TO RELATED APPLICATIONS

This application is a continuation application claiming priority under 35 U.S.C. § 120 from co-pending U.S. patent application Ser. No. 16/779,689, now U.S. Pat. No. 11,319,616, filed on Feb. 3, 2020, which is a continuation of U.S. patent application Ser. No. 16/122,450, now U.S. Pat. No. 10,619,226, filed on Sep. 5, 2018, which is a continuation of U.S. application Ser. No. 14/594,300, now U.S. Pat. No. 10,094,003, filed on Jan. 12, 2015, the entire disclosures of which are hereby incorporated by reference herein.

BACKGROUND OF THE TECHNOLOGY

Field of the Technology

The present disclosure relates to high strength alpha-beta titanium alloys.

DESCRIPTION OF THE BACKGROUND OF THE TECHNOLOGY

Titanium alloys typically exhibit a high strength-to-weight ratio, are corrosion resistant, and are resistant to creep at moderately high temperatures. For these reasons, titanium alloys are used in aerospace, aeronautic, defense, marine, and automotive applications including, for example, landing gear members, engine frames, ballistic armor, hulls, and mechanical fasteners.

Reducing the weight of an aircraft or other motorized vehicle results in fuel savings. Thus, for example, there is a strong drive in the aerospace industry to reduce aircraft weight. Titanium and titanium alloys are attractive materials for achieving weight reduction in aircraft applications because of their high strength-to-weight ratios. Most titanium alloy parts used in aerospace applications are made from Ti-6Al-4V alloy (ASTM Grade 5; UNS R56400; AMS 4928, AMS 4911), which is an alpha-beta titanium alloy.

Ti-6Al-4V alloy is one of the most common titanium-based manufactured materials, estimated to account for over 50% of the total titanium-based materials market. Ti-6Al-4V alloy is used in a number of applications that benefit from the alloy's advantageous combination of light weight, corrosion resistance, and high strength at low to moderate temperatures. For example, Ti-6Al-4V alloy is used to produce aircraft engine components, aircraft structural components, fasteners, high-performance automotive components, components for medical devices, sports equipment, components for marine applications, and components for chemical processing equipment.

Ductility is a property of any given metallic material (i.e., metals and metal alloys). Cold-formability of a metallic material is based somewhat on the near room temperature ductility and ability for a material to deform without cracking. High-strength alpha-beta titanium alloys, such as, for example, Ti-6Al-4V alloy, typically have low cold-formability at or near room temperature. This limits their acceptance of low-temperature processing, such as cold rolling, because these alloys are susceptible to cracking and breakage when worked at low temperatures. Therefore, due to their limited cold formability at or near room temperature, alpha-beta titanium alloys typically are processed by techniques involving extensive hot working.

Titanium alloys that exhibit room temperature ductility generally also exhibit relatively low strength. A consequence of this is that high-strength alloys are typically more costly and have reduced gage control due to grinding tolerances. This problem stems from the deformation of the hexagonal close packed (HCP) crystal structure in these higher-strength beta alloys at temperatures below several hundred degrees Celsius.

The HCP crystal structure is common to many engineering materials, including magnesium, titanium, zirconium, and cobalt alloys. The HCP crystal structure has an ABABAB stacking sequence, whereas other metallic alloys, like stainless steel, brass, nickel, and aluminum alloys, typically have a face centered cubic (FCC) crystal structures with ABCABCABC stacking sequences. As a result of this difference in stacking sequence, HCP metals and alloys have a significantly reduced number of mathematically possible independent slip systems relative to FCC materials. A number of the independent slip systems in HCP metals and alloys require significantly higher stresses to activate, and these "high resistance" deformation modes are activated in only extremely rare instances. This effect is temperature sensitive, such that below temperatures of several hundred degrees Celsius, titanium alloys have significantly lower malleability.

In combination with the slip systems present in HCP materials, a number of twinning systems are possible in unalloyed HCP metals. The combination of the slip systems and the twinning systems in titanium enables sufficient independent modes of deformation so that "commercially pure" (CP) titanium can be cold worked at temperatures in the vicinity of room temperature (i.e., in an approximate temperature range of −148° F. (−100° C.) to 392° F. (+200° C.)).

Alloying effects in titanium and other HCP metals and alloys tend to increase the asymmetry, or difficulty, of "high resistance" slip modes, as well as suppress twinning systems from activation. A result is the macroscopic loss of cold-processing capability in alloys such as Ti-6Al-4V alloy and Ti-6Al-2-Sn-4Zr-2Mo-0.1Si alloy. Ti-6Al-4V and Ti-6Al-2-Sn-4Zr-2Mo-0.1S alloys exhibit relatively high strength due to their high concentration of alpha phase and high level of alloying elements. In particular, aluminum is known to increase the strength of titanium alloys, at both room and elevated temperatures. However, aluminum also is known to adversely affect room temperature processing capability.

In general, alloys exhibiting cold deformation capability can be manufactured more efficiently, in terms of both energy consumption and the amount of scrap generated during processing. Thus, in general, it is advantageous to formulate an alloy that can be processed at relatively low temperatures.

Some known titanium alloys have delivered increased room-temperature processing capability by including large concentrations of beta phase stabilizing alloying additions. Examples of such alloys include Beta C titanium alloy (Ti-3Al-8V-6Cr-4Mo-4Zr; UNS R58649), which is commercially available in one form as ATI® 38-644™ beta titanium alloy from Allegheny Technologies Incorporated, Pittsburgh, Pennsylvania USA. This alloy, and similarly formulated alloys, provides advantageous cold-processing capability by decreasing and or eliminating alpha phase from the microstructure. Typically, these alloys can precipitate alpha phase during low-temperature aging treatments.

Despite their advantageous cold processing capability, beta titanium alloys, in general, have two disadvantages: expensive alloy additions and poor elevated-temperature creep strength. The poor elevated-temperature creep strength is a result of the significant concentration of beta phase these alloys exhibit at elevated temperatures such as, for example, 500° C. Beta phase does not resist creep well due to its body centered cubic structure, which provides for a large number of deformation mechanisms. Machining beta titanium alloys also is known to be difficult due to the alloys' relatively low elastic modulus, which allows more significant spring-back. As a result of these shortcomings, the use of beta titanium alloys has been limited.

Lower cost titanium products would be possible if existing titanium alloys were more resistant to cracking during cold processing. Since alpha-beta titanium alloys represent the majority of all alloyed titanium produced, cost could be further reduced by volumes of scale if this type of alloy were maintained. Therefore, interesting alloys to examine are high-strength, cold-deformable alpha-beta titanium alloys. Several alloys within this alloy class have been developed recently. For example, in the past 15 years Ti-4Al-2.5V alloy (UNS R54250), Ti-4.5Al-3V-2Mo-2Fe alloy, Ti-5Al-4V-0.7Mo-0.5Fe alloy, and Ti-3Al-5Mo-5V-3Cr-0.4Fe alloy have been developed. Many of these alloys feature expensive alloying additions, such as V and/or Mo.

Ti-6Al-4V alpha-beta titanium alloy is the standard titanium alloy used in the aerospace industry, and it represents a large fraction of all alloyed titanium in terms of tonnage. The alloy is known in the aerospace industry as not being cold workable at room temperatures. Lower oxygen content grades of Ti-6Al-4V alloy, designated as Ti-6Al-4V ELI ("extra low interstitials") alloys (UNS 56401), generally exhibit improved room temperature ductility, toughness, and formability compared with higher oxygen grades. However, the strength of Ti-6Al-4V alloy is significantly lowered as oxygen content is reduced. One skilled in the art would consider the addition of oxygen as being deleterious to cold forming capability and advantageous to strength in Ti-6Al-4V alloys.

However, despite having higher oxygen content than standard grade Ti-6Al-4V alloy, Ti-4Al-2.5V-1.5Fe-0.25O alloy (also known as Ti-4Al-2.5V alloy) is known to have superior forming capabilities at or near room temperature compared with Ti-6Al-4V alloy. Ti-4Al-2.5V-1.5Fe-0.25O alloy is commercially available as ATI 425® titanium alloy from Allegheny Technologies Incorporated. The advantageous near room temperature forming capability of ATI 425® alloy is discussed in U.S. Pat. Nos. 8,048,240, 8,597,442, and 8,597,443, and in U.S. Patent Publication No. 2014-0060138 A1, each of which is hereby incorporated by reference herein in its entirety.

Another cold-deformable, high strength alpha-beta titanium alloy is Ti-4.5Al-3V-2Mo-2Fe alloy, also know as SP-700 alloy. Unlike Ti-4Al-2.5V alloy, SP-700 alloy contains higher cost alloying ingredients. Similar to Ti-4Al-2.5V alloy, SP-700 alloy has reduced creep resistance relative to Ti-6Al-4V alloy due to increased beta phase content.

Ti-3Al-5Mo-5V-3Cr alloy also exhibits good room temperature forming capabilities. This alloy, however, includes significant beta phase content at room temperature and, thus, exhibits poor creep resistance. Additionally, it contains a significant level of expensive alloying ingredients, such as molybdenum and chromium.

It is generally understood that cobalt does not substantially affect mechanical strength and ductility of most titanium alloys compared with alternative alloying additions. It has been described that while cobalt addition increases the strength of binary and ternary titanium alloys, cobalt addition also typically reduces ductility more severely than addition of iron, molybdenum, or vanadium (typical alloying additions). It has been demonstrated that while cobalt additions in Ti-6Al-4V alloy can improve strength and ductility, intermetallic precipitates of the $Ti_3X$-type also can form during aging and deleteriously affect other mechanical properties.

It would be advantageous to provide a titanium alloy that includes relatively minor levels of expensive alloying additions, exhibits an advantageous combination of strength and ductility, and does not develop substantial beta phase content.

SUMMARY

According to a non-limiting aspect of the present disclosure, an alpha-beta titanium alloy comprises, in weight percentages: an aluminum equivalency in the range of 2.0 to 10.0; a molybdenum equivalency in the range of 0 to 20.0; 0.3 to 5.0 cobalt; titanium; and incidental impurities. Aluminum equivalency, as defined herein, is in terms of an equivalent weight percentage of aluminum and is calculated by the following equation, in which the content of each alpha phase stabilizer element is in weight percent:

$$[Al]_{eq}=[Al]+\tfrac{1}{3}[Sn]+\tfrac{1}{6}[Zr+Hf]+10[O+2N+C]+[Ga]+[Ge].$$

Molybdenum equivalency, as defined herein, is in terms of an equivalent weight percentage of molybdenum and is calculated by the following equation, in which the content of each beta phase stabilizer element is in weight percent:

$$[Mo]_{eq}=[Mo]+\tfrac{2}{3}[V]+3[Mn+Fe+Ni+Cr+Cu+Be]+\tfrac{1}{3}[Ta+Nb+W].$$

According to another non-limiting aspect of the present disclosure, an alpha-beta titanium alloy comprises, in weight percentages: 2.0 to 7.0 aluminum; a molybdenum equivalency in the range of 2.0 to 5.0; 0.3 to 4.0 cobalt; up to 0.5 oxygen; up to 0.25 nitrogen; up to 0.3 carbon; up to 0.4 of incidental impurities; and titanium. The molybdenum equivalency is provided by the equation:

$$[Mo]_{eq}=[Mo]+\tfrac{2}{3}[V]+3[Mn+Fe+Ni+Cr+Cu+Be]+\tfrac{1}{3}[Ta+Nb+W].$$

An additional non-limiting aspect of the present disclosure is directed to a method of forming an article from an alpha-beta titanium alloy. In a non-limiting embodiment, a method of forming an alpha-beta titanium alloy comprises cold working a metallic form to at least a 25 percent reduction in cross-sectional area, wherein the metallic form does not exhibit substantial cracking during cold working. In a non-limiting embodiment, the metallic form comprises an alpha-beta titanium alloy comprising in weight percentages: an aluminum equivalency in the range of 2.0 to 10.0; a molybdenum equivalency in the range of 0 to 20.0; 0.3 to 5.0 cobalt; titanium; and incidental impurities. Aluminum equivalency is in terms of an equivalent weight percentage of aluminum and is calculated by the following equation, in which the content of each alpha phase stabilizer element is in weight percent:

$$[Al]_{eq}=[Al]+\tfrac{1}{3}[Sn]+\tfrac{1}{6}[Zr+Hf]+10[O+2N+C]+[Ga]+[Ge].$$

Molybdenum equivalency is in terms of an equivalent weight percentage of molybdenum and is calculated by the following equation, in which the content of each beta phase stabilizer element is in weight percent:

$$[Mo]_{eq}=[Mo]+\tfrac{2}{3}[V]+3[Mn+Fe+Ni+Cr+Cu+Be]+\tfrac{1}{3}[Ta+Nb+W].$$

Another non-limiting aspect of the present disclosure is directed to a method of forming an article from an alpha-beta titanium alloy. In a non-limiting embodiment, forming an alpha-beta titanium alloy comprises providing an alpha-beta titanium alloy comprising, in weight percentages: 2.0 to 7.0 aluminum; a molybdenum equivalency in the range of 2.0 to 5.0; 0.3 to 4.0 cobalt; up to 0.5 oxygen; up to 0.25 nitrogen; up to 0.3 carbon; up to 0.2 of incidental impurities; and titanium. The method further includes producing a cold workable structure, where the material is amenable to cold reductions of 25% or more in cross-sectional area without resulting in substantial cracking, as defined herein.

It is understood that the invention disclosed and described in this specification is not limited to the embodiments summarized in this Summary.

BRIEF DESCRIPTION OF THE DRAWINGS

Various features and characteristics of the non-limiting and non-exhaustive embodiments disclosed and described in this specification may be better understood by reference to the accompanying figures, in which.

DESCRIPTION

Figure 1:
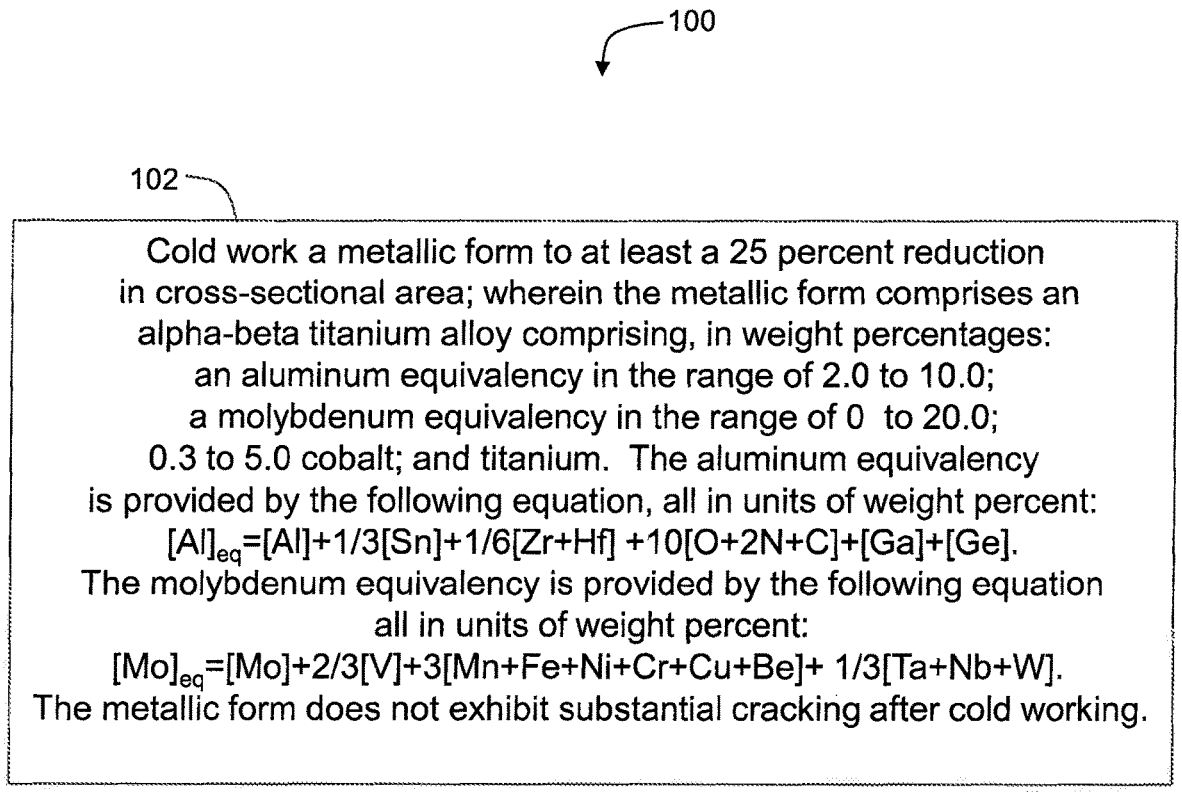
FIG. 1 is a flow diagram of a non-limiting embodiment of a method according to the present disclosure.

The reader will appreciate the foregoing details, as well as others, upon considering the following detailed description of various non-limiting and non-exhaustive embodiments according to the present disclosure.

Various embodiments are described and illustrated in this specification to provide an overall understanding of the structure, function, operation, manufacture, and use of the disclosed processes and products. It is understood that the various embodiments described and illustrated in this specification are non-limiting and non-exhaustive. Thus, the invention is not limited by the description of the various non-limiting and non-exhaustive embodiments disclosed in this specification. Rather, the invention is defined solely by the claims. The features and characteristics illustrated and/or described in connection with various embodiments may be combined with the features and characteristics of other embodiments. Such modifications and variations are intended to be included within the scope of this specification. As such, the claims may be amended to recite any features or characteristics expressly or inherently described in, or otherwise expressly or inherently supported by, this specification. Further, Applicant reserves the right to amend the claims to affirmatively disclaim features or characteristics that may be present in the prior art. Therefore, any such amendments comply with the requirements of 35 U.S.C. § 112, first paragraph, and 35 U.S.C. § 132(a). The various embodiments disclosed and described in this specification can comprise, consist of, or consist essentially of the features and characteristics as variously described herein.

All percentages and ratios provided for an alloy composition are based on the total weight of the particular alloy composition, unless otherwise indicated.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

In this specification, other than where otherwise indicated, all numerical parameters are to be understood as being prefaced and modified in all instances by the term "about", in which the numerical parameters possess the inherent variability characteristic of the underlying measurement techniques used to determine the numerical value of the parameter. At the very least, and not as an attempt to limit the application of the doctrine of equivalents to the scope of the claims, each numerical parameter described in the present description should at least be construed in light of the number of reported significant digits and by applying ordinary rounding techniques.

Also, any numerical range recited in this specification is intended to include all sub-ranges of the same numerical precision subsumed within the recited range. For example, a range of "1.0 to 10.0" is intended to include all sub-ranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited in this specification is intended to include all lower numerical limitations subsumed therein and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such sub-ranges would comply with the requirements of 35 U.S.C. § 112, first paragraph, and 35 U.S.C. § 132(a). Additionally, as used herein when referring to compositional elemental ranges, the term "up to" includes zero unless the particular element is present as an unavoidable impurity.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

As used herein, the term "billet" refers to a solid semi-finished product, commonly having a generally round or square cross-section, that has been hot worked by forging, rolling, or extrusion. This definition is consistent with the definition of "billet" in, for example, ASM Materials Engineering Dictionary, J. R. Davis, ed., ASM International (1992), p. 40.

As used herein, the term "bar" refers to a solid product forged, rolled or extruded from a billet to a form commonly having a symmetrical, generally round, hexagonal, octagonal, square, or rectangular cross-section, with sharp or rounded edges, and that has a length greater than its cross-sectional dimensions. This definition is consistent with the definition of "bar" in, for example, ASM Materials Engineering Dictionary, J. R. Davis, ed., ASM International (1992), p. 32. It is recognized that as used herein, the term "bar" may refer to the form described above, except that the form may not have a symmetrical cross-section, such as, for example a non-symmetrical cross-section of a hand rolled bar.

As used herein, the phrase "cold working" refers to working a metallic (i.e., a metal or metal alloy) article at a temperature below that at which the flow stress of the material is significantly diminished. Examples of cold working involve processing a metallic article at such temperatures using one or more techniques selected from rolling, forging, extruding, pilgering, rocking, drawing, flow-turning, liquid compressive forming, gas compressive forming, hydro-forming, flow forming, bulge forming, roll forming, stamping, fine-blanking, die pressing, deep drawing, coining, spinning, swaging, impact extruding, explosive forming, rubber forming, back extrusion, piercing, stretch forming, press bending, electromagnetic forming, and cold heading. As used herein in connection with the present invention, "cold working", "cold worked", "cold forming", and like terms, and "cold" used in connection with a particular working or forming technique, refer to working or the characteristic of having been worked, as the case may be, at a temperature no greater than about 1250° F. (677° C.). In certain embodiments, such working occurs at a temperature no greater than about 1000° F. (538° C.). In certain other embodiments, cold working occurs at a temperature no greater than about 575° F. (300° C.). The terms "working" and "forming" are generally used interchangeably herein, as are the terms "workability" and "formability" and like terms.

As used herein, the phrase "ductility limit" refers to the limit or maximum amount of reduction or plastic deformation a metallic material can withstand without fracturing or cracking. This definition is consistent with the definition of "ductility limit" in, for example, ASM Materials Engineering Dictionary, J. R. Davis, ed., ASM International (1992), p 131. As used herein, the term "reduction ductility limit" refers to the amount or degree of reduction that a metallic material can withstand before cracking or fracturing.

Reference herein to an alpha-beta titanium alloy "comprising" a particular composition is intended to encompass alloys "consisting essentially of" or "consisting of" the stated composition. It will be understood that alpha-beta titanium alloy compositions described herein that "comprise", "consist of", or "consist essentially of" a particular composition also may include incidental impurities.

A non-limiting aspect of the present disclosure is directed to a cobalt-containing alpha-beta titanium alloy that exhibits certain cold-deformation properties superior to Ti-6Al-4V alloy, but without the need to provide additional beta phase or further restrict the oxygen content compared to Ti-6Al-4V alloy. The ductility limit of the alloys of the present disclosure is significantly increased compared to that of Ti-6Al-4V alloy.

Contrary to the current understanding that oxygen additions to titanium alloys reduce the formability of the alloys, the cobalt-containing alpha-beta titanium alloys disclosed herein possess greater formability than Ti-6Al-4V alloy while including up to 66% greater oxygen content than Ti-6Al-4V alloy. The compositional range of cobalt-containing alpha-beta titanium alloy embodiments disclosed herein enables greater flexibility of alloy usage, without adding substantial cost associated with alloy additions. While various embodiments of alloys according to the present disclosure may be more expensive than Ti-4Al-2.5V alloy in terms of starting materials costs, the alloying additive costs for the cobalt-containing alpha-beta titanium alloys disclosed herein may be less than certain other cold formable alpha-beta titanium alloys.

The addition of cobalt in the alpha-beta titanium alloys disclosed herein has been found to increase the ductility of the alloys when the alloys also include low levels of aluminum. In addition the addition of cobalt to the alpha-beta titanium alloys according to the present disclosure has been found to increase alloy strength.

According to a non-limiting embodiment of the present disclosure, an alpha-beta titanium alloy comprises, in weight percentages: an aluminum equivalency in the range of 2.0 to 10.0; a molybdenum equivalency in the range of 0 to 20.0; 0.3 to 5.0 cobalt; titanium; and incidental impurities.

In another non-limiting embodiment, an alpha-beta titanium alloy comprises, in weight percentages an aluminum equivalency in the range of 2.0 to 10.0; a molybdenum equivalency in the range of 0 to 10.0; 0.3 to 5.0 cobalt; and titanium. In yet another non-limiting embodiment, an alpha-beta titanium alloy comprises, in weight percentages an aluminum equivalency in the range of 1.0 to 6.0; a molybdenum equivalency in the range of 0 to 10.0; 0.3 to 5.0 cobalt; and titanium. For each of the embodiments disclosed herein, aluminum equivalency is in terms of an equivalent weight percentage of aluminum and is calculated by the following equation, in which the content of each alpha phase stabilizer element is in weight percent:

$$[Al]_{eq}=[Al]+\tfrac{1}{3}[Sn]+\tfrac{1}{6}[Zr+Hf]+10[O+2N+C]+[Ga]+[Ge].$$

While it is known that cobalt is a beta phase stabilizer for titanium, for all embodiments disclosed herein, molybdenum equivalency is in terms of an equivalent weight percentage of molybdenum and is calculated herein by the following equation, in which the content of each beta phase stabilizer element is in weight percent:

$$[Mo]_{eq}=[Mo]+\tfrac{2}{3}[V]+3[Mn+Fe+Ni+Cr+Cu+Be]+\tfrac{1}{3}[Ta+Nb+W].$$

In certain non-limiting embodiments according to the present disclosure, the cobalt-containing alpha-beta titanium alloys disclosed herein include greater than 0 up to 0.3 total weight percent of one or more grain refinement additives. The one or more grain refinement additives may be any of the grain refinement additives known to those having ordinary skill in the art, including, but not necessarily limited to, cerium, praseodymium, neodymium, samarium, gadolinium, holmium, erbium, thulium, yttrium, scandium, beryllium, and boron.

In further non-limiting embodiments, any of the cobalt-containing alpha-beta titanium alloys disclosed herein may further include greater than 0 up to 0.5 total weight percent of one or more corrosion inhibiting metal additives. The corrosion inhibiting additives may any one or more of the corrosion inhibiting additives known for use in alpha-beta titanium alloys. Such additives include, but are not limited to, gold, silver, palladium, platinum, nickel, and iridium.

In further non-limiting embodiments, any of the cobalt-containing alpha-beta titanium alloys disclosed herein may include one or more of, in weight percentages: greater than 0 up to 6.0 tin; greater than 0 up to 0.6 silicon; greater than 0 up to 10 zirconium. It is believed that additions of these elements within these concentration ranges will not affect the ratio of the concentrations of alpha and beta phases in the alloy.

In certain non-liming embodiments of an alpha-beta titanium alloy according to the present disclosure, the alpha-beta titanium alloy exhibits a yield strength of at least 130 KSI (896.3 MPa) and a percent elongation of at least 10%. In other non-limiting embodiments, the alpha-beta titanium alloy exhibits a yield strength of at least 150 KSI (1034 MPa) and a percent elongation of at least 16%.

In certain non-liming embodiments of an alpha-beta titanium alloy according to the present disclosure, the alpha-beta titanium alloy exhibits a cold working reduction ductility limit of at least 20%. In other non-liming embodiments, the alpha-beta titanium alloy exhibits a cold working reduction ductility limit of at least 25%, or at least 35%.

In certain non-liming embodiments of an alpha-beta titanium alloy according to the present disclosure, the alpha-beta titanium alloy further comprises aluminum. In a non-limiting embodiment, the alpha-beta titanium alloy comprises, in weight percentages: 2.0 to 7.0 aluminum; a molybdenum equivalency in the range of 2.0 to 5.0; 0.3 to 4.0 cobalt; up to 0.5 oxygen; up to 0.25 nitrogen; up to 0.3 carbon; up to 0.2 of incidental impurities; and titanium. The molybdenum equivalency is determined as described herein. In certain non-limiting embodiments, alpha-beta titanium alloys herein comprising aluminum may further comprise one or more of, in weight percentages: greater than 0 to 6 tin; greater than 0 to 0.6 silicon; greater than 0 to 10 zirconium; greater than 0 to 0.3 palladium; and greater than 0 to 0.5 boron.

In certain non-liming embodiments of an alpha-beta titanium alloy according to the present disclosure comprising aluminum, the alloys may further include greater than 0 up to 0.3 total weight percent of one or more grain refinement additives. The one or more grain refinement additives may be, for example, any of the grain refinement additives cerium, praseodymium, neodymium, samarium, gadolinium, holmium, erbium, thulium, yttrium, scandium, beryllium, and boron.

In certain non-limiting embodiments of an alpha-beta titanium alloy according to the present disclosure comprising aluminum, the alloys may further include greater than 0 up to 0.5 total weight percent of one or more corrosion resistance additives known to those having ordinary skill in the art, including, but not necessarily limited to gold, silver, palladium, platinum, nickel, and iridium.

Certain non-liming embodiments of the alpha-beta titanium alloys disclosed herein comprising cobalt and aluminum exhibit a yield strength of at least 130 KSI (896 MPa) and a percent elongation of at least 10%. Other non-limiting embodiments of the alpha-beta titanium alloys herein comprising cobalt and aluminum exhibit a yield strength of at least 150 KSI (1034 MPa) and a percent elongation of at least 16%.

Certain non-limiting embodiments of the alpha-beta titanium alloys disclosed herein comprising cobalt and aluminum exhibit a cold working reduction ductility limit of at least 25%. Other non-liming embodiments of the alpha-beta titanium alloys herein comprising cobalt and aluminum exhibit a cold working reduction ductility limit of at least 35%.

Referring to FIG. 1, another aspect of the present disclosure is directed to a method 100 of forming an article from a metallic form comprising an alpha-beta titanium alloy according to the present disclosure. The method 100 comprises cold working 102 a metallic form to at least a 25 percent reduction in cross-sectional area. The metallic form comprises any of the alpha-beta titanium alloys disclosed herein. During cold working 102, according to an aspect of the present disclosure, the metallic form does not exhibit substantial cracking. The term "substantial cracking" is defined herein as the formation of any single crack exceeding no more than 0.5 inch, and preferably no more than 0.25 inch. In another non-limiting embodiment of a method of forming an article according to the present disclosure, a metallic form comprising an alpha-beta titanium alloy as disclosed herein is cold worked 102 to at least a 35 percent reduction in cross-sectional area. During cold working 102, the metallic form does not exhibit substantial cracking.

In a specific embodiment, cold working 102 the metallic form comprises cold rolling the metallic form.

In a non-limiting embodiment of a method according to the present disclosure, the metallic form is cold worked 102 at a temperature less than 1250° F. (676.7° C.). In another non-limiting embodiment of a method according to the present disclosure, the metallic form is cold worked 102 at a temperature no greater than 575° F. (300° C.). In another non-limiting embodiment of a method according to the present disclosure, the metallic form is cold worked 102 at a temperature less than 392° F. (200° C.). In still another non-limiting embodiment of a method according to the present disclosure, the metallic form is cold worked 102 at a temperature in the range of −148° F. (−100° C.) to 392° F. (+200° C.).

In a non-limiting embodiment of a method according to the present disclosure, the metallic form is cold worked 102 between intermediate anneals (not shown) to a reduction of at least 25% or at least 35%. The metallic form may be annealed between intermediate multiple cold working steps at a temperature less than the beta-transus temperature of the alloy in order relieve internal stresses and minimize chances of edge cracking. In non-limiting embodiments, an annealing step (not shown) intermediate cold working steps 102 may include annealing the metallic form at a temperature in the range of $T_\beta$−36° F. ($T_\beta$−20° C.) and $T_\beta$−540° F. ($T_\beta$−300° C.) for 5 minutes to 2 hours. The $T_\beta$ of alloys of the present disclosure is typically between 1652° F. (900° C.) and 2012° F. (1100° C.). The $T_\beta$ of any specific alloy of the present disclosure can be determined using conventional techniques by a person having ordinary skill in the art without undue experimentation.

After the step of cold working 102 the metallic form, in certain non-limiting embodiments of the present method, the metallic form may be mill annealed (not shown) to obtain desired strength and ductility and the alpha-beta microstructure of the alloy. Mill annealing, in a non-limiting embodiment, may include heating the metallic form to a temperature in a range of 1112° F. (600° C.) to 1706° F. (930° C.) and holding for 5 minutes to 2 hours.

The metallic form processed according to various embodiments of the methods disclosed herein may be selected from any mill product or semi-finished mill product. The mill product or semi-finished mill product may be selected from, for example, an ingot, a billet, a bloom, a bar, a beam, a slab, a rod, a wire, a plate, a sheet, an extrusion, and a casting.

A non-limiting embodiment of the methods disclosed herein further comprises hot working (not shown) the metallic form prior to cold working 102 the metallic form. A person skilled in the art understands that hot working involves plastically deforming a metallic form at temperatures above the recrystallization temperature of the alloy comprising the metallic form. In certain non-limiting embodiments, the metallic form may be hot worked at a temperature in the beta phase field of the alpha-beta titanium alloy. In one specific non-limiting embodiment, the metallic form is heated to a temperature of at least $T_\beta$+54° F. ($T_\beta$+30°

C.), and hot worked. In certain non-limiting embodiments, the metallic form may be hot worked at a temperature in the beta phase field of the titanium alloy to at least a 20 percent reduction. In certain non-limiting embodiments, after hot working the metallic form in the beta phase field, the metallic form may be cooled to ambient temperature at a rate that is at least comparable to air cooling.

After hot working at a temperature in the beta phase field, in various non-limiting embodiments of a method according to the present disclosure, the metallic form may be further hot worked at a temperature in the alpha-beta phase field. Hot working in the alpha-beta phase field may include reheating the metallic form to a temperature in the alpha-beta phase field. Alternatively, after working the metallic form in the beta phase field, the metallic form may be cooled to a temperature in the alpha-beta phase field and then further hot worked. In a non-limiting embodiment, the hot working temperature in the alpha-beta phase field is in a range of $T_\beta$−540° F. ($T_\beta$−300° C.) to $T_\beta$−36° F. ($T_\beta$−20° C.). In a non-limiting embodiment, the metallic form is hot worked in the alpha-beta phase field to a reduction of at least 30%. In a non-limiting embodiment, after hot working in the alpha-beta phase filed, the metallic form may be cooled to ambient temperature at a rate that is at least comparable to air cooling. After cooling, in a non-limiting embodiment, the metallic form may be annealed at a temperature in the range of $T_\beta$−36° F. ($T_\beta$−20°) to $T_\beta$−540° F. ($T_\beta$−300° C.) for 5 minutes to 2 hours.

Figure 2:
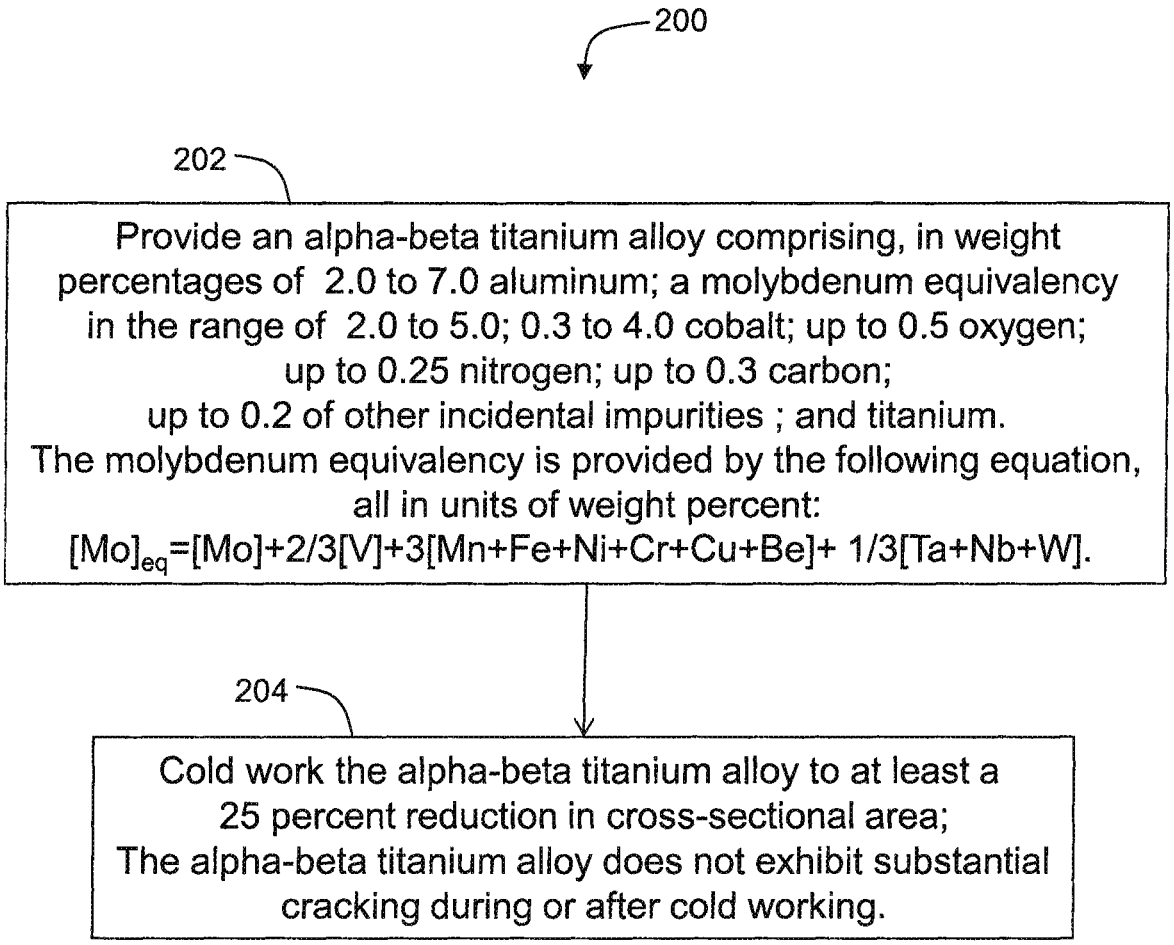
FIG. 2 is a flow diagram of another non-limiting embodiment of a method according to the present disclosure.

Referring now to FIG. 2, another non-limiting aspect of the present disclosure is directed to a method 200 of forming an article from an alpha-beta titanium alloy, wherein the method comprises providing 202 an alpha-beta titanium alloy comprising, in weight percentages: 2.0 to 7.0 aluminum; a molybdenum equivalency in the range of 2.0 to 5.0; 0.3 to 4.0 cobalt; up to 0.5 oxygen; up to 0.25 nitrogen; up to 0.3 carbon; up to 0.2 of incidental impurities; and titanium. As such, the alloy is referred to as a cobalt-containing, aluminum-containing, alpha-beta titanium alloy. The alloy is cold worked 204 to at least a 25 percent reduction in cross-sectional area. The cobalt-containing, aluminum-containing, alpha-beta titanium alloy does not exhibit substantial cracking during the cold working 204.

The molybdenum equivalency of the cobalt-containing, aluminum containing, alpha-beta titanium alloy is provided by the following equation, in which the beta phase stabilizers listed in the equation are weight percentages:

$$[Mo]_{eq}=[Mo]+\tfrac{2}{3}[V]+3[Mn+Fe+Ni+Cr+Cu+Be]+\tfrac{1}{3}[Ta+Nb+W].$$

In another non-limiting method embodiment of the present disclosure, the cobalt-containing, aluminum-containing, alpha-beta titanium alloy is cold worked to a reduction in cross-sectional area of at least 35 percent.

In a non-limiting embodiment, cold working 204 the cobalt containing, aluminum-containing, alpha-beta titanium alloy to a reduction of at least 25%, or at least 35%, may take place in one or more cold rolling steps. The cobalt containing, aluminum-containing, alpha-beta titanium alloy may be annealed (not shown) intermediate multiple cold working steps 204 at a temperature less than the beta-transus temperature in order relieve internal stresses and minimize chances of edge cracking. In non-limiting embodiments, an annealing step intermediate cold working steps may include annealing the cobalt containing, aluminum-containing, alpha-beta titanium alloy at a temperature in the range of $T_\beta$−36° F. ($T_\beta$-20°) to $T_\beta$−540° F. ($T_\beta$-300° C.) for 5 minutes to 2 hours. The $T_\beta$ of alloys of the present disclosure is typically between 1652° F. (900° C.) and 2192° F. (1200° C.). The $T_\beta$ of any specific alloy of the present disclosure can be determined by a person having ordinary skill in the art without undue experimentation.

After cold working 204, in a non-limiting embodiment, the cobalt containing, aluminum-containing, alpha-beta titanium alloy may be mill annealed (not shown) to obtain the desired strength and ductility. Mill annealing, in a non-limiting embodiment, may include heating the cobalt containing, aluminum-containing, alpha-beta titanium alloy to a temperature in a range of 1112° F. (600° C.) to 1706° F. (930° C.) and holding for 5 minutes to 2 hours.

In a specific embodiment, cold working 204 of the cobalt-containing, aluminum-containing, alpha-beta titanium alloy disclosed herein comprises cold rolling.

In a non-limiting embodiment, the cobalt-containing, aluminum-containing, alpha-beta titanium alloy disclosed herein is cold worked 204 at a temperature of less than 1250° F. (676.7° C.). In another non-limiting embodiment of a method according to the present disclosure, the cobalt-containing, aluminum-containing, alpha-beta titanium alloy disclosed herein is cold worked 204 at a temperature no greater than 575° F. (300° C.). In another non-limiting embodiment, the cobalt-containing, aluminum-containing, alpha-beta titanium alloy disclosed herein is cold worked 204 at a temperature of less than 392° F. (200° C.). In still another non-limiting embodiment, the cobalt-containing, aluminum-containing, alpha-beta titanium alloy disclosed herein is cold worked 204 at a temperature in a range of −148° F. (−100° C.) to 392° F. (200° C.)

Prior to the cold working step 204, the cobalt-containing, aluminum-containing, alpha-beta titanium alloy disclosed herein may be a mill product or semi-finished mill product in a form selected from one of an ingot, a billet, a bloom, a beam, a slab, a rod, a bar, a tube, a wire, a plate, a sheet, an extrusion, and a casting.

Also prior to the cold working step, the cobalt-containing, aluminum-containing, alpha-beta titanium alloy disclosed herein may be hot worked (not shown). Hot working processes that are disclosed for the metallic form hereinabove are equally applicable to the cobalt-containing, aluminum-containing, alpha-beta titanium alloy disclosed herein.

The cold formability of the cobalt-containing, alpha-beta titanium alloys disclosed herein, which includes higher oxygen levels than found, for example, in Ti-6Al-4V alloy, is counter-intuitive. For example, Grade 4 CP (Commercially Pure) titanium, which includes a relatively high level of up to 0.4 weight percent oxygen, is known to be less formable than other CP grades. While the Grade 4 CP alloy has higher strength than Grades 1, 2, or 3 CP, it exhibits a lower strength than embodiments of the alloys disclosed herein.

Cold working techniques that may be used with the cobalt-containing, alpha-beta titanium alloys disclosed herein include, for example, but are not limited to, cold rolling, cold drawing, cold extrusion, cold forging, rocking/pilgering, cold swaging, spinning, and flow-turning. As is known in the art, cold rolling generally consists of passing previously hot rolled articles, such as bars, sheets, plates, or strip, through a set of rolls, often several times, until a desired gauge is obtained. Depending upon the starting structure after hot (alpha-beta) rolling and annealing, it is believed that at least a 35-40% reduction in area (RA) could be achieved by cold rolling a cobalt-containing, alpha-beta titanium alloy before any annealing is required prior to further cold rolling. Subsequent cold reductions of at least 20-60%, or at least 25%, or at least 35%, are believed possible, depending on product width and mill configuration.

Based on the inventor's observations, cold rolling of bar, rod, and wire on a variety of bar-type mills, including Koch's-type mills, also may be accomplished on the cobalt-containing, alpha-beta titanium alloys disclosed herein. Additional non-limiting examples of cold working techniques that may be used to form articles from the cobalt-containing, alpha-beta titanium alloys disclosed herein include pilgering (rocking) of extruded tubular hollows for the manufacture of seamless pipe, tube, and ducting. Based on the observed properties of the cobalt-containing, alpha-beta titanium alloys disclosed herein, it is believed that a larger reduction in area (RA) may be achieved in compressive type forming than with flat rolling. Drawing of rod, wire, bar, and tubular hollows also may be accomplished. A particularly attractive application of the cobalt-containing, alpha-beta titanium alloys disclosed herein is drawing or pilgering to tubular hollows for production of seamless tubing, which is particularly difficult to achieve with Ti-6Al-4V alloy. Flow forming (also referred to in the art as shear-spinning) may be accomplished using the cobalt-containing, alpha-beta titanium alloys disclosed herein to produce axially symmetric hollow forms including cones, cylinders, aircraft ducting, nozzles, and other "flow-directing"-type components. A variety of liquid or gas-type compressive, expansive type forming operations such as hydroforming or bulge forming may be used. Roll forming of continuous-type stock may be accomplished to form structural variations of "angle iron" or "uni-strut" generic structural members. In addition, based on the inventor's findings, operations typically associated with sheet metal processing, such as stamping, fine-blanking, die pressing, deep drawing, and coining may be applied to the cobalt-containing, alpha-beta titanium alloys disclosed herein.

In addition to the above cold forming techniques, it is believed that other "cold" techniques that may be used to form articles from the cobalt-containing, alpha-beta titanium alloys disclosed herein include, but are not necessarily limited to, forging, extruding, flow-turning, hydro-forming, bulge forming, roll forming, swaging, impact extruding, explosive forming, rubber forming, back extrusion, piercing, spinning, stretch forming, press bending, electromagnetic forming, and cold heading. Those having ordinary skill, upon considering the inventor's observations and conclusions and other details provided in the present description of the invention, may readily comprehend additional cold working/forming techniques that may be applied to the cobalt-containing, alpha-beta titanium alloys disclosed herein. Also, those having ordinary skill may readily apply such techniques to the alloys without undue experimentation. Accordingly, only certain examples of cold working of the alloys are described herein. The application of such cold working and forming techniques may provide a variety of articles. Such articles include, but are not necessarily limited to the following: a sheet, a strip, a foil, a plate, a bar, a rod, a wire, a tubular hollow, a pipe, a tube, a cloth, a mesh, a structural member, a cone, a cylinder, a duct, a pipe, a nozzle, a honeycomb structure, a fastener, a rivet, and a washer.

The unexpected cold workability of the cobalt-containing, alpha-beta titanium alloys disclosed herein results in finer surface finishes and a reduced need for surface conditioning to remove the heavy surface scale and diffused oxide layer that typically results on the surface of a Ti-6Al-4V alloy pack rolled sheet. Given the level of cold workability the present inventor has observed, it is believed that foil thickness product in coil lengths may be produced from the cobalt-containing, alpha-beta titanium alloys disclosed herein with properties similar to those of Ti-6Al-4V alloy.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

Example 1

Two alloys were made having compositions such that limited cold formability was anticipated. The compositions of these alloys, in weight percentages, and their observed rollability are presented in Table 1.

TABLE 1

| Ti | Al | Zr | O | N | C | Fe | Co | V | Hot rollable? | Cold rollable? |
|---|---|---|---|---|---|---|---|---|---|---|
| 86.97 | 4.1 | 3.1 | 0.13 | 0.08 | 0.02 | 1.6 | 0.0 | 4.0 | No | No |
| 87.05 | 4.1 | 3.1 | 0.14 | 0.09 | 0.02 | 0.0 | 1.6 | 3.9 | Yes | Yes |

The alloys were melted and cast into buttons by non-consumable arc melting. Subsequent hot rolling was conducted in the beta phase field, and then in the alpha-beta phase field to produce a cold-rollable microstructure. During this hot rolling operation the non-cobalt containing alloy failed in a catastrophic manner, resulting from lack of ductility. In comparison, the cobalt-containing alloy was successfully hot rolled from about 1.27 cm (0.5 inch) thick to about 0.381 cm (0.15 inch) thick. The cobalt-containing alloy was then cold-rolled.

The cobalt-containing alloy was then subsequently cold rolled to a final thickness of below 0.76 mm (0.030 inch) with intermediate annealing and conditioning. Cold rolling was conducted until the onset of cracks exhibiting a length of 0.635 cm (0.25 inch) was observed. The percent reduction achieved during cold working until edge cracks were observed, i.e., the cold reduction ductility limit, was recorded. It was surprisingly observed in this example that a cobalt-containing alpha-beta titanium alloy was successfully hot and then cold rolled, without exhibiting substantial cracks, to at least a 25 percent cold rolling reduction, whereas the comparative alloy, which lacked a cobalt addition, could not be hot rolled without failing in a catastrophic manner.

Example 2

The mechanical performance of a second alloy (Heat 5) within the scope of the present disclosure was compared with a small coupon of Ti-4Al-2.5V alloy. Table 2 lists the composition of Heat 5 and, for comparison purposes, the composition a heat of a Ti-4Al-2.5V (which lacks Co). The compositions in Table 2 are provided in weight percentages.

TABLE 2

| Alloy | Al | V | O | Fe | Co | C | YS (ksi) | UTS (ksi) | % El. |
|---|---|---|---|---|---|---|---|---|---|
| Ti—4Al—2.5V | 4.1 | 2.6 | 0.24 | 1.53 | 0.0 | 0.0 | 140 | 154 | 4 |
| Heat 5 | 3.6 | 2.7 | 0.26 | 0.85 | 0.95 | 0.05 | 150 | 162 | 16 |

Buttons of Heat 5 and the comparative Ti-4Al-2.5V alloy were prepared by melting, hot rolling, and then cold rolling in the same manner as the cobalt-containing alloy of Example 1. The yield strength (YS), ultimate tensile strength (UTS), and percent elongation (% El.) were measured according to ASTM E8/E8M-13a and are listed in Table 2. Neither alloy exhibited cracking during the cold rolling. The strength and ductility (% El.) of the Heat 5 alloy exceeded those of the Ti-4Al-2.5V button.

Example 3

The cold rolling capability, or the reduction ductility limit, was compared based on alloy composition. Buttons of alloy Heats 1-4 were compared with a button having the same composition as the Ti-4Al-2.5V alloy used in Example 2. The buttons were prepared by melting, hot rolling, and then cold rolling in the manner used for the cobalt-containing alloy of Example 1. The buttons were cold rolled until substantial cracking was observed. Table 3 lists the compositions (remainder titanium and incidental impurities) of the inventive and comparative buttons, in weight percentages, and the cold working reduction ductility limit expressed in percent reduction of the hot rolled buttons.

TABLE 3

| Button Heat No. | Al | Zr | O | V | Nb | Cr | Fe | Co | Si | Cold Reduction Ductility Limit (%) |
|---|---|---|---|---|---|---|---|---|---|---|
| Heat 1 | 3.6 | 5.1 | 0.30 | 3.3 | 0 | 0 | 0 | 1 | 0 | 53 |
| Heat 2 | 3.5 | 5.1 | 0.30 | 2.1 | 2.6 | 0 | 0 | 1 | 0 | 51 |
| Heat 3 | 3.8 | 0 | 0.30 | 3.8 | 0 | 0 | 0 | 1 | 0.1 | 62 |
| Heat 4 | 3.8 | 0 | 0.30 | 0 | 0 | 2 | 0 | 1.6 | 0 | 55 |
| Ti—4Al—2.5V | 4.1 | 0 | 0.24 | 2.6 | 0 | 0 | 1.53 | 0 | 0 | 40 |

From the results in Table 3, it is observed that higher oxygen content is tolerated without loss of cold ductility in the alloys containing cobalt. The inventive alpha-beta titanium alloy heats (Heats 1-4) exhibited cold reduction ductility limits that were superior to the button of the Ti-4Al-2.5V alloy. For comparison, it is noted that Ti-6Al-4V alloy cannot be cold rolled for commercial purposes without the onset of cracking, and typically contains 0.14 to 0.18 weight percent oxygen. These results clearly show that the cobalt-containing alpha-beta alloys of the present disclosure surprisingly exhibited strengths and cold ductility that are at least comparable to Ti-4Al-2.5 alloy, strengths that are comparable to Ti-6Al-4V alloy, and cold ductility that is clearly superior to Ti-6Al-4V alloy.

In Table 2, the cobalt-containing alpha-beta titanium alloys of the present disclosure exhibit greater ductility and strength than a Ti-4Al-2.5V alloy. The results listed in Tables 1-3 show that the cobalt-containing alpha-beta titanium alloys of the present disclosure exhibit significantly greater cold ductility than Ti-6Al-4V alloy, despite having 33-66% more interstitial content, which tends to decrease ductility.

It was not anticipated that cobalt additions would increase the cold rolling capability of an alloy containing high levels of interstitial alloying elements, such as oxygen. From the perspective of an ordinarily skilled practitioner, it was unanticipated that cobalt additions would increase cold-ductility without reducing strength levels. Intermetallic precipitates of $Ti_3X$-type, where X represents a metal, typically reduce cold ductility quite substantially, and it has been shown in the art that cobalt does not substantially increase strength or ductility. Most alpha-beta titanium alloys contain approximately 6% aluminum, which can form $Ti_3Al$ when combined with cobalt additions. This can have a deleterious effect on ductility.

The results presented hereinabove surprisingly demonstrate that cobalt additions do in fact improve ductility and strength in the present titanium alloys compared with Ti-4Al-2.5V alloy and other cold deformable alpha+beta alloys. Embodiments of the present alloys include a combination of alpha stabilizers, beta stabilizers, and cobalt.

Cobalt additions apparently work with other alloying additions to enable the alloys of the present disclosure to have high oxygen tolerance without negatively affecting ductility or cold processing capability. Traditionally, high oxygen tolerance is not commensurate with cold ductility and high strength simultaneously.

By maintaining a high level of alpha phase in the alloy, it may be possible to preserve machinability of cobalt-containing alloys compared with other alloys having a greater beta phase content, such as, for example, Ti-5553 alloy, Ti-3553 alloy, and SP-700 alloy. Cold ductility also increases the degree of dimensional control and control of surface finish achievable compared with other high-strength alpha-beta titanium alloys that are not cold-deformable in mill products.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

What is claimed is:

1. An alpha-beta titanium alloy comprising, in weight percentages:

2.0 to 7.0 aluminum;
greater than 0 to 6.0 tin;
2.1 to 7.5 vanadium;
0.3 to 5.0 cobalt;
a molybdenum equivalency in the range of 2.0 to 20.0;
up to 0.5 oxygen;
titanium; and
incidental impurities.

2. The alpha-beta titanium alloy of claim 1, comprising a molybdenum equivalency in the range of 2.0 to 10.0.

3. The alpha-beta titanium alloy of claim 1, comprising a molybdenum equivalency in the range of 2.0 to 5.0.

4. The alpha-beta titanium alloy of claim 1, comprising 2.1 to 3.8 vanadium.

5. The alpha-beta titanium alloy of claim 1, comprising 2.1 to 3.3 vanadium.

6. The alpha-beta titanium alloy of claim 1, comprising no greater than incidental concentrations of molybdenum, manganese, nickel, chromium, copper, beryllium, tantalum, niobium, and tungsten.

7. The alpha-beta titanium alloy of claim 1, comprising 2.0 to 4.1 aluminum.

8. The alpha-beta titanium alloy of claim 1, comprising 4.1 to 7.0 aluminum.

9. The alpha-beta titanium alloy of claim 1, comprising 3.5 to 5.5 aluminum.

10. The alpha-beta titanium alloy of claim 1, comprising 0.3 to 1.6 cobalt.

11. The alpha-beta titanium alloy of claim 1, comprising 0.14 to 0.5 oxygen.

12. The alpha-beta titanium alloy of claim 1, comprising 0.14 to 0.3 oxygen.

13. The alpha-beta titanium alloy of claim 1, comprising 0.1 to 0.3 oxygen.

14. The alpha-beta titanium alloy of claim 1, comprising an aluminum equivalency in the range of 2.0 to 10.0.

15. The alpha-beta titanium alloy of claim 1, comprising no greater than incidental concentrations of zirconium, hafnium, nitrogen, carbon, gallium, and germanium.

16. The alpha-beta titanium alloy of claim 1, comprising 1.5 to 4.5 tin.

17. An alpha-beta titanium alloy comprising, in weight percentages:

2.0 to 4.1 aluminum;
greater than 0 to 6.0 tin;
2.1 to 7.5 vanadium;
0.3 to 5.0 cobalt;
a molybdenum equivalency in the range of 2.0 to 10.0;
0.14 to 0.5 oxygen;
titanium; and
incidental impurities.

18. The alpha-beta titanium alloy of claim 17, comprising a molybdenum equivalency in the range of 2.0 to 5.0.

19. The alpha-beta titanium alloy of claim 17, comprising 2.1 to 3.8 vanadium.

20. The alpha-beta titanium alloy of claim 17, comprising 2.1 to 3.3 vanadium.

21. The alpha-beta titanium alloy of claim 17, comprising no greater than incidental concentrations of molybdenum, manganese, nickel, chromium, copper, beryllium, tantalum, niobium, and tungsten.

22. The alpha-beta titanium alloy of claim 17, comprising 4.1 to 7.0 aluminum.

23. The alpha-beta titanium alloy of claim 17, comprising 0.3 to 1.6 cobalt.

24. The alpha-beta titanium alloy of claim 17, comprising 0.14 to 0.3 oxygen.

* * * * *